US010477990B2

(12) United States Patent
Seba Raffoul et al.

(10) Patent No.: US 10,477,990 B2
(45) Date of Patent: Nov. 19, 2019

(54) DISPLAY STAND

(71) Applicants: José David Seba Raffoul, Ottawa (CA); Julia Dahdah Dahdah, Ottawa (CA)

(72) Inventors: José David Seba Raffoul, Ottawa (CA); Julia Dahdah Dahdah, Ottawa (CA)

( * ) Notice: Subject to any disclaimer, the term of this patent is extended or adjusted under 35 U.S.C. 154(b) by 0 days.

(21) Appl. No.: 15/554,790

(22) PCT Filed: Feb. 29, 2016

(86) PCT No.: PCT/CA2016/050210

§ 371 (c)(1),
(2) Date: Aug. 31, 2017

(87) PCT Pub. No.: WO2016/138579

PCT Pub. Date: Sep. 9, 2016

(65) Prior Publication Data

US 2018/0042404 A1 Feb. 15, 2018

Related U.S. Application Data

(60) Provisional application No. 62/128,909, filed on Mar. 5, 2015.

(51) Int. Cl.

| | |
|---|---|
| ***A47F 5/11*** | (2006.01) |
| ***A47F 7/00*** | (2006.01) |
| ***A47F 5/10*** | (2006.01) |

(52) U.S. Cl.

CPC ..... *A47F 5/116* (2013.01); *A47F 5/108* (2013.01); *A47F 5/112* (2013.01); *A47F 7/0071* (2013.01)

(58) Field of Classification Search

CPC ..... A47F 5/0018; A47F 5/116; A47F 5/108; A47F 5/112; A47F 7/0071

See application file for complete search history.

(56) References Cited

U.S. PATENT DOCUMENTS

| | | | | | |
|---|---|---|---|---|---|
| D160,688 | S | * | 10/1950 | Brock | 211/128.1 |
| D198,096 | S | * | 4/1964 | Rosenthal et al. | D7/505 |
| 4,334,623 | A | * | 6/1982 | Geary | A47G 23/0208 211/131.1 |
| 4,488,652 | A | | 12/1984 | Hinton | |
| 4,947,999 | A | * | 8/1990 | Warp | A47B 96/00 108/901 |

(Continued)

FOREIGN PATENT DOCUMENTS

| | | | | |
|---|---|---|---|---|
| DE | 10330602 A1 | | 12/2004 | |
| GB | 2480921 A | * | 12/2011 | A47G 19/02 |

(Continued)

OTHER PUBLICATIONS

Office Action issued on corresponding Canadian Patent Application No. 2,978,355, dated Sep. 15, 2017.

(Continued)

*Primary Examiner* — Ko H Chan

(74) *Attorney, Agent, or Firm* — Brion Raffoul

(57) ABSTRACT

A display stand suitable for displaying items with round, flat or uneven bottoms, including desserts such as French macarons is disclosed. The display stand can be assembled by the user, and includes at least one base sheet and at least one shelf sheet.

20 Claims, 27 Drawing Sheets

(56) References Cited

U.S. PATENT DOCUMENTS

| | | | | |
|---|---|---|---|---|
| 6,308,838 | B1 * | 10/2001 | Endean | A47F 7/08 211/205 |
| D560,974 | S * | 2/2008 | Goode | D7/500 |
| D803,007 | S * | 11/2017 | Liao | D7/610 |
| 2014/0217047 | A1 | 8/2014 | Frost | |

FOREIGN PATENT DOCUMENTS

| | | | |
|---|---|---|---|
| GB | 2507257 | A | 4/2014 |
| WO | 03079862 | A1 | 10/2003 |

OTHER PUBLICATIONS

ISA/CA, International Search Report and Written Opinion issued on corresponding PCT Application No. PCT/CA2016/050210, dated May 25, 2016.

* cited by examiner

DISPLAY STAND

TECHNICAL FIELD

This invention relates to the field of display stands. More specifically, this invention relates to a display stand and a display stand kit that requires assembly by the user.

BACKGROUND

Display stands for round objects such as French macarons and truffles are often cumbersome, delicate, heavy, require storage, space consuming, and are displeasing to the eye. Furthermore, such display stands often cannot serve multiple purposes such as flower display, organizer, storage device, and decorative item simultaneously.

Existing display stands are often difficult to find in brick-and-mortar vendor locations, and must be purchased from online vendors. Depending on a user's location, expensive shipment charges may be incurred due to the excessive weight and/or large dimensions of the products.

The decorative capacity of existing display stands is limited. Often, the display itself is limited by its design and ornamentation to any further decoration. In other words, many existing display stands may only be decorated by the addition of the object for display. Furthermore, such displays have few, if any, variations of set up, and are therefore not very versatile. Additionally, once assembled and decorated, existing display stands are often difficult to transport.

One commonly used display stand for macarons consists of a set of short stackable cups with protruding rims that serve as shelves. The cups partly nest into one another creating a tower of spaced apart shelves. These display stands may be inconvenient for users because they are cumbersome to transport and store when not in use, difficult to carry when assembled and decorated, space consuming to display and store, not disposable, usually because they are costly, and often require hand-washing.

Another example of an existing disposable French macaron display stand requires the dessert to be adhered to the display by an adhesive. Such display stands may also include an integrated box that is often inseparable from the display stand. Such non-removable display boxes may also require disassembly around the display stand, consuming valuable space on a display table, inconveniencing the user, and lacking elegance in presentation.

French macarons may also be displayed in disposable boxes. Such boxes may be simple rectangular boxes or may be specialized to house French macarons.

Specialized boxes may include macaron-shaped indentations to house the desserts. Such displays therefore only accommodate one size and shape of item that can be displayed, inconveniencing the user, and limiting the goods that can be displayed. Both simple and specialized boxes have the convenience of portability, however they are neither elegant nor versatile.

Cupcake stands provide another example of a common disposable dessert display stand. Disposable cupcake stands are most often constructed from heavy cardboard. Such display stands include a display surface with legs. Several of these cardboard display surfaces with legs are stacked one above the other to create a tower of display shelves. Such display stands are only suitable for flat-bottomed items such as cupcakes and are not suitable for round-shaped desserts such as French macarons, truffles, and other round items. Furthermore, they are not customizable and are limited in their decorative capacity.

French choux, small round pastries, are often displayed without the aid of an external stand. The choux pastries are stacked into a cone shape and adhered to one another using an edible adhesive such as caramel. This beautiful edible display is known as a croquembouche. Croquembouches are very difficult and time-consuming to make. To aid in the assembly of the croquembouche display, pastry chefs sometimes use cones constructed of food-safe materials as a base to which they adhere and decorate a layer of choux pastries. A significant amount of skill and time is required to assemble croquembouche, even with the aid of a cone base.

There is therefore a need to mitigate, if not overcome, the shortcomings of the prior art and to provide a display stand that is customizable, disposable, versatile, easy to assemble, lightweight and portable.

SUMMARY

The present invention provides a display stand capable of displaying items with round, flat or uneven bottoms, including desserts such as French macarons. The display stand may be sold in an assembled or an unassembled state, such as a kit.

In a first aspect, the present disclosure provides a display stand comprising at least one base sheet, which when assembled forms a base unit, the at least one base sheet having an outward facing surface, an inward facing surface, and a bottom edge; and at least one shelf sheet having a shelf surface, the at least one shelf sheet being for attachment to the base unit, wherein the at least one base sheet is assembled by operatively attaching a first section of the base sheet to a second section of the base sheet by way of a first connection means, and the at least one shelf sheet is attached to the base unit by way of a second connection means.

In a second aspect, the present disclosure provides a kit for assembly into a display stand, the kit comprising at least one base sheet having an outward facing surface, an inward facing surface, and a bottom edge; and at least one shelf sheet, the at least one shelf sheet having a shelf surface, an inner edge, and an outer edge, wherein the at least one base sheet is for assembling into the display stand by operatively attaching a first section of the at least one base sheet to a second section of the at least one base sheet by way of a first connection means, and the at least one shelf sheet is attached to the base by way of a second connection means.

BRIEF DESCRIPTION OF THE DRAWINGS

The embodiments of the present invention will now be described by reference to the following figures, in which identical reference numerals in different figures indicate identical elements and in which.

The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention.

DETAILED DESCRIPTION

The present invention includes a display stand suitable for displaying items with round, flat or uneven bottoms, including desserts such as French macarons. The display stand can be assembled by the user, and includes at least one base sheet and at least one shelf sheet.

Figure 1:
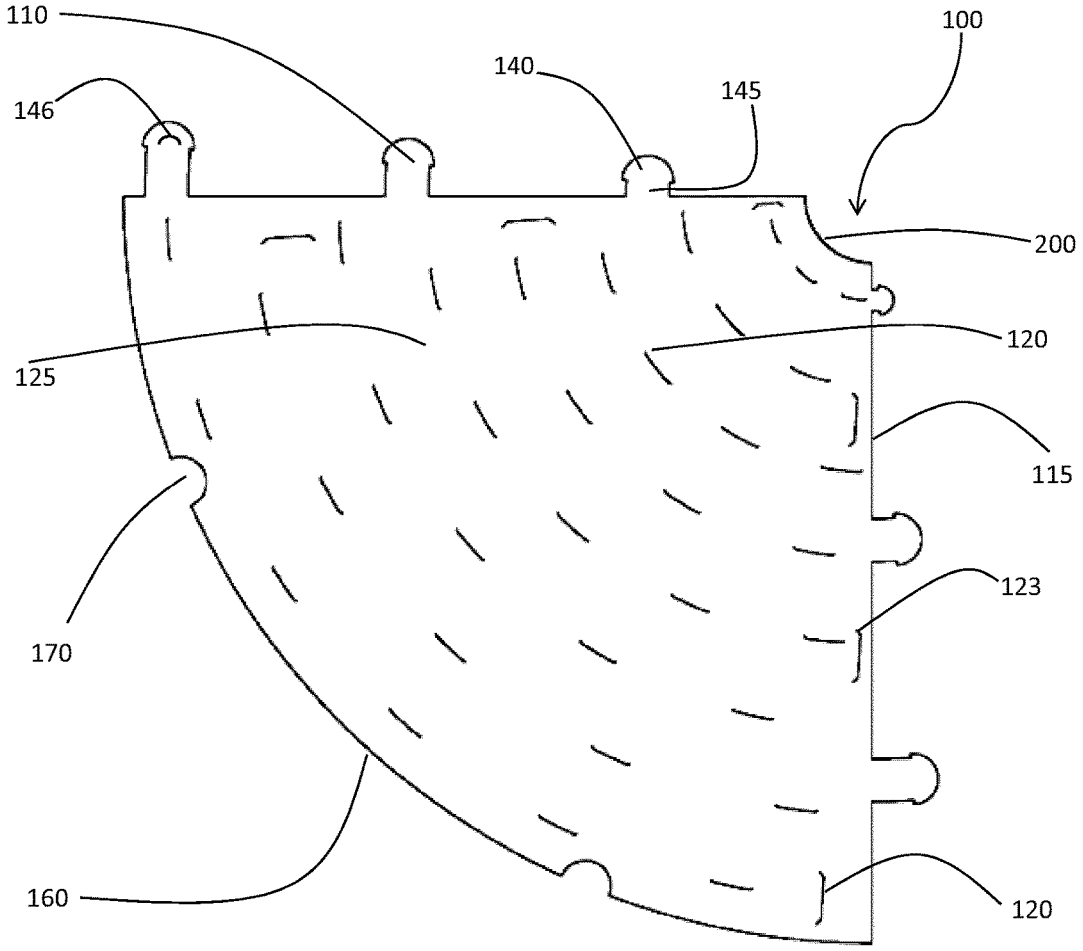
FIG. 1 shows an unassembled base sheet of the display stand according to one embodiment of the present invention.

FIG. 1 shows one embodiment of the present invention wherein the base sheet 100 includes a connection means consisting of inserts 110 near a side edge 115 and openings 120, hereinafter referred to as slits 120, on the sheet surface 125. Inserts 110 mate with the slits 120 of a base sheet 100 to form an assembled base sheet 100 shown in FIG. 3. In one embodiment, the slits 120 for mating with the inserts 110 near the side edge 115 may be located inward from the side edge to provide assembled base sheets 100 with a smaller sized base. In another embodiment, there may be several sets of side slits 120 for mating with the inserts 110 near the side edge 115 so that the size of the base may be adjustable, which each set of side slits 120 corresponding to a different size of assembled base sheet. It should be understood by the skilled artisan that other connection means may be contemplated. For example, an adhesive connection (not shown) may be utilized to assemble the display stand.

In FIG. 1, the head 140 of the insert 110 is inserted into the slit 120 to secure the head 140. The slit 120 may include at least one angled edge 123 to secure the head 140 of the insert 110 within the slit 120. The insert 110 may include a neck 145 and a head 140, or only a head 140 as shown in FIG. 7. The head 140 may form any shape or design, including, but not limited to, triangles, hearts, ovals, semicircles, crescents, rectangles and other shapes. Further in FIG. 1, the head 140 may include a secondary securing means such as a small slot 146 to help further secure the head 140 in the slit 120.

As shown in FIG. 1, the bottom edge 160 of the base sheet 100 may, as an alternative, include indentations 170 as a transportation means for carrying the assembled base sheet 100. The base sheet 100 also has several slits 120 within the sheet surface 125 for attaching a shelf sheet 190 or 195 (shown in FIGS. 7, 8 and 9). As an alternative, inserts 110 and slits 120 of several base sheets 100 may mate with one another as described above to form various assembled base sheet 100 configurations (not shown).

Figure 2A:
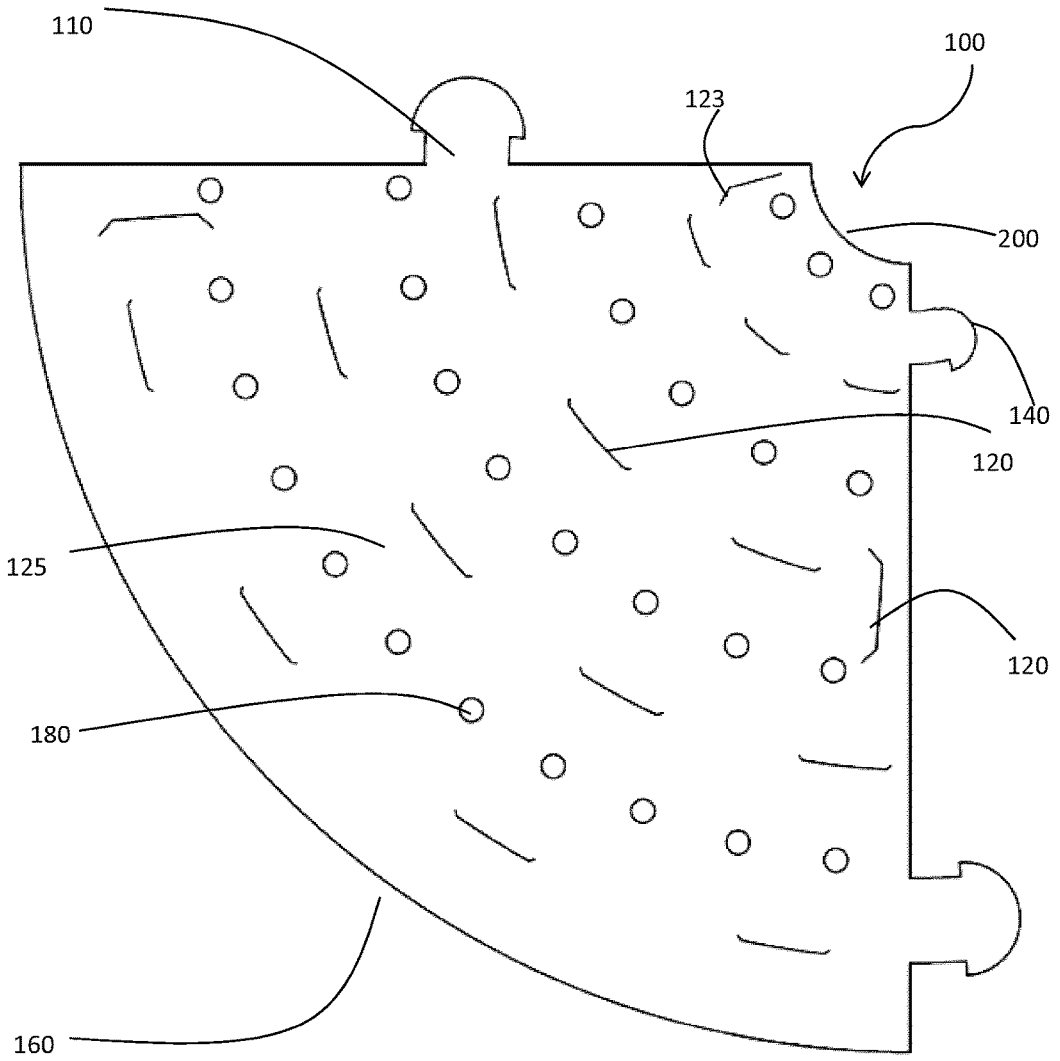
FIG. 2A shows an unassembled base sheet of the display stand according to another embodiment of the present invention.

FIG. 2A shows another embodiment of the present invention where an unassembled base sheet 100 includes at least one hole 180 in the sheet surface 125 for increased decorative versatility. For example, items on sticks or with stems, such as lollipops, cake pops, or stemmed flowers, may be inserted in the holes 180 for display. In this particular embodiment, the holes 180 run substantially parallel to and alongside the slits 120 throughout the sheet surface 125. In another embodiment of the present invention, the hole 180 or holes 180 may be placed throughout sheet surface 125 of the base sheet 100 randomly or in any pattern.

Figure 2B:
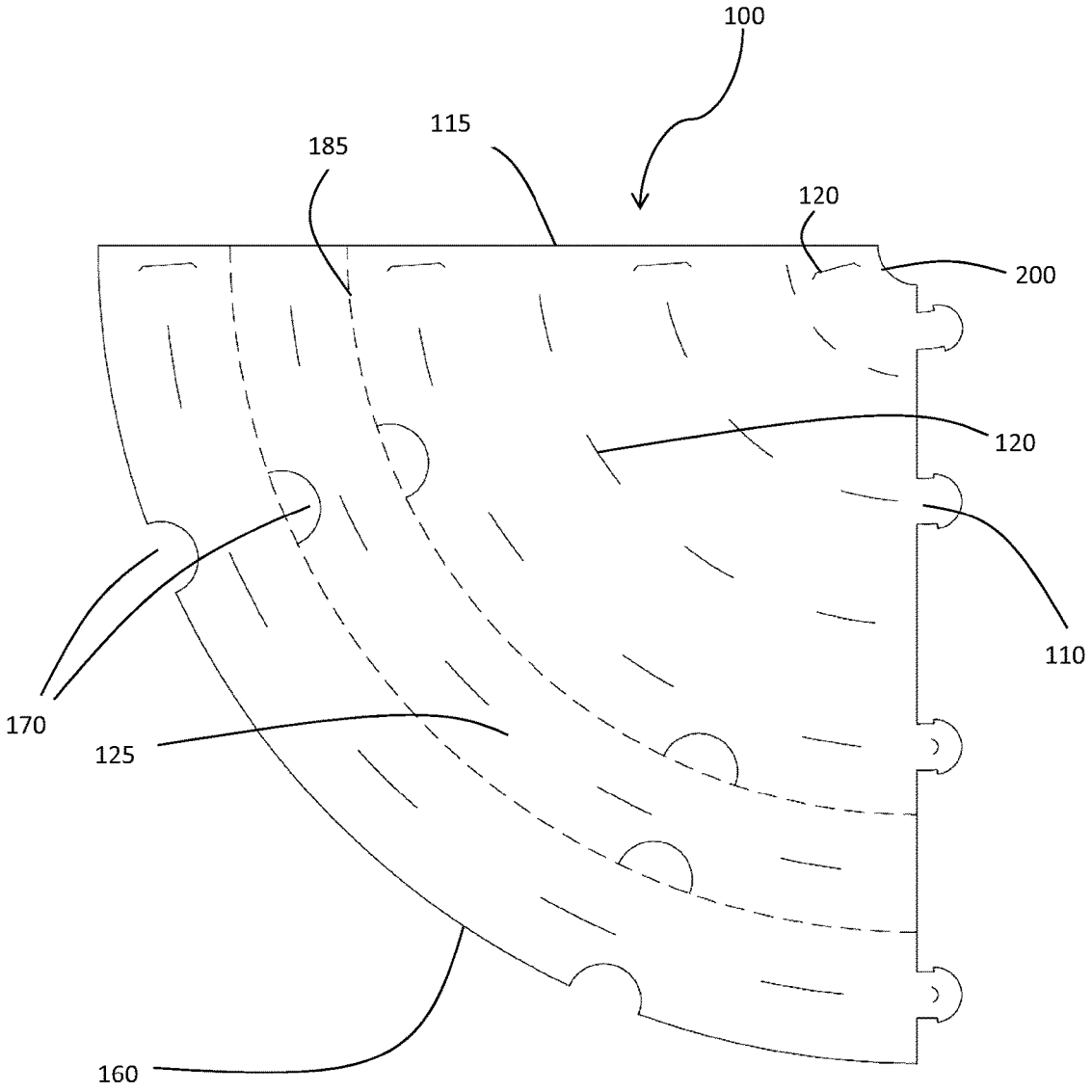
FIG. 2B shows an unassembled base sheet of the display stand according to a further embodiment of the present invention.

FIG. 2B shows a further embodiment of the present invention where an unassembled base sheet 100 includes at least one adjustment line 185 for adjusting the size of the display stand. In one embodiment, the adjustment line 185 may be substantially parallel to the bottom edge 160. In this embodiment, cutting folding along the adjustment line 185 adjusts the height of the assembled display stand.

In another embodiment, the adjustment line 185 may be substantially parallel to the side edge 115.

Similarly, cutting or folding along the adjustment line 185, and subsequently assembling the display stand, narrows or adjusts the size of the base of the display stand. Similarly, in a further embodiment, the adjustment line 185 may run so that it forms any angle with the bottom edge 160 or the top edge 200. Folding or cutting along this angled adjustment line 185 may adjust the shape of the assembled display sheet 100. Similarly, this angled adjustment line 185 may also act as a connection or coupling point between multiple sheets 100. For example, the structure 400 in FIG. 15 was constructed by connecting multiple sheets to form the different shapes in structure 400.

In one embodiment, the adjustment line 185 may comprise perforations for tearing or cutting. In another embodiment, the adjustment line 185 may be a drawn and/or engraved line indicating where the sheet 100 may be cut or torn.

In a further embodiment the adjustment line 185 may be scored into the sheet 100 for folding. In addition to shortening the height of the sheet, this embodiment may reinforce the base of the display stand, or may provide a decorative feature for the assembled display stand.

As shown in FIG. 2B, the adjustment line 185 may be a line substantially parallel with the bottom edge 160 with pre-cut indentations 170 included above the adjustment line 185. It may also be readily contemplated that the adjustment line 185 may be straight, curved, angled, sinusoidal, zigzagged, or any irregular shape for decorative purposes or to form indentations 170 from the cutting of the line. As one example, the adjustment line 185 may include the outline of at least one insert 110 for the creation of attachment means. These attachment means can be used for optional customizable attachments to another sheet 100 in a structure 400 as described with reference to FIG. 15.

Figure 3:
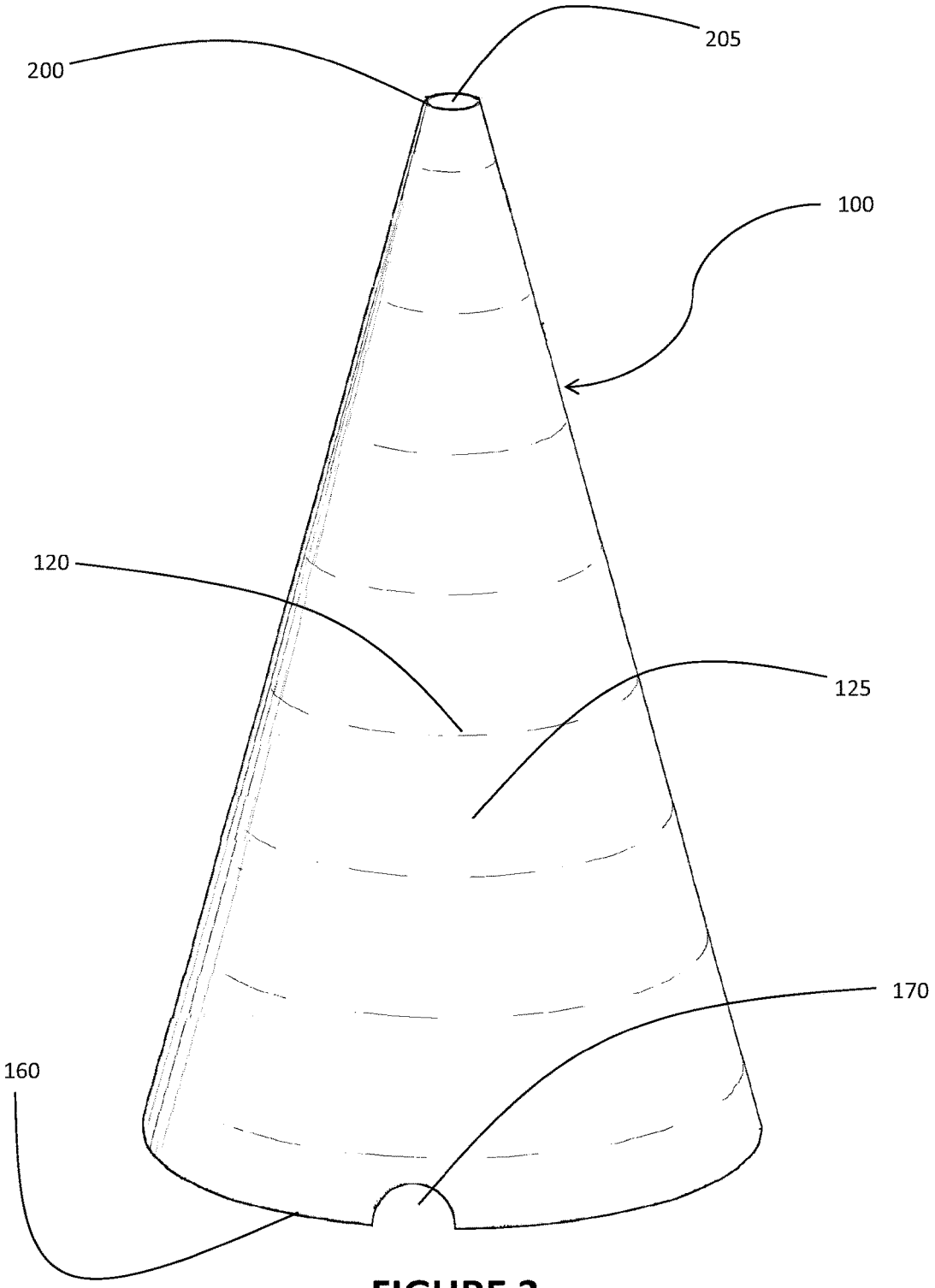
FIG. 3 shows an assembled base of the display stand shown in FIG. 1.

FIG. 3 shows a base sheet 100 that is assembled into a conical shape. The base sheet 100 includes several slits 120 running parallel to the bottom edge 160 for attaching shelves 190 or 195 (shown in FIGS. 7, 8 and 9). The bottom edge 160 has indentations 170 for carrying the assembled base sheet 100. The top edge 200 forms an opening 205. As may be readily contemplated by a skilled artisan, the top edge 200 may come to a point or there may be an opening 205. The opening 205 may also serve as a top shelf for an item being displayed, or may be covered by a shelf sheet 190 (see FIG. 7). The opening 205 may also be covered by or connected to a topper 206, shown in FIGS. 4A and 19-21.

Figure 4A:
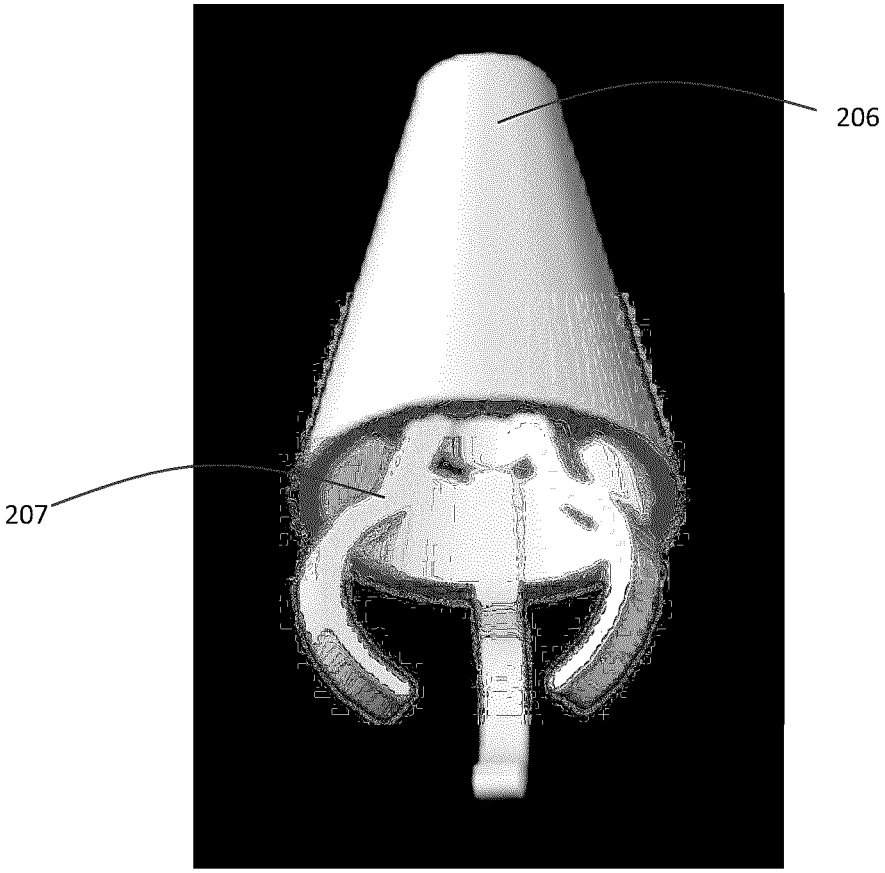
FIG. 4A shows a topper according to a further embodiment of the present invention.

FIG. 4A shows one embodiment of the topper 206. The topper 206 may be attached to the display stand 290 by an attachment means as described, or may be fitted with one or more prongs 207. The topper may be a balloon (shown in FIG. 19), a candle holder, a dip-container (shown in FIGS. 4D and 20), a card-holder (shown in FIG. 21), a picture frame, or a decorative sign denoting a phrase, image or design.

Figure 4B:
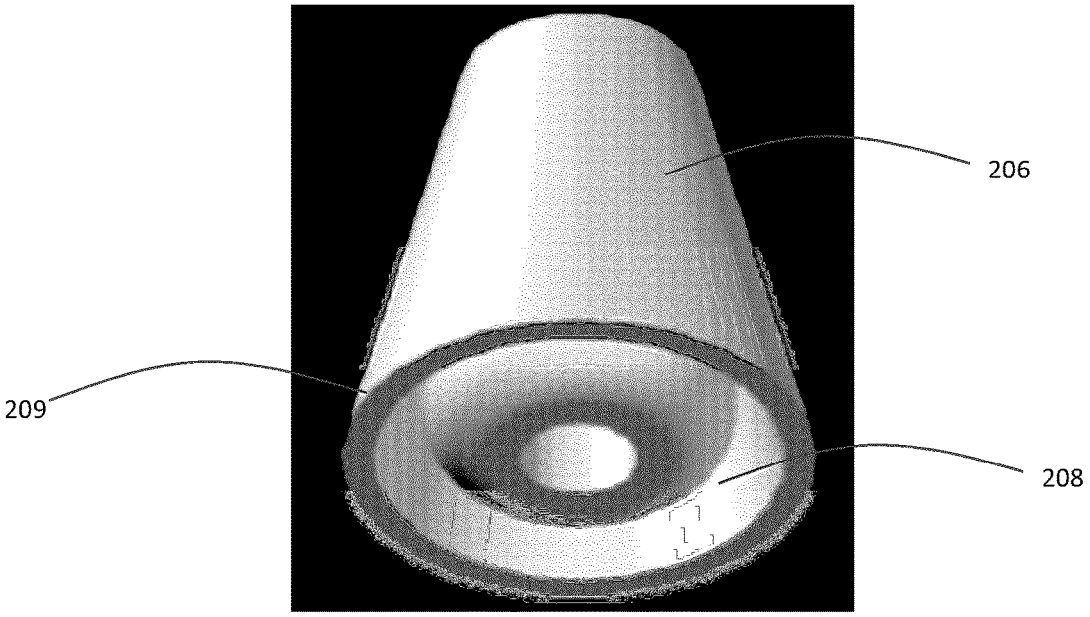
FIG. 4B shows a schematic of the topper according to another embodiment of the present invention.

FIG. 4B shows a schematic of the topper 206 according to another embodiment of the present invention. Here, the topper 206 includes a gap 208 formed substantially along the periphery of the topper base 209.

Figure 4C:
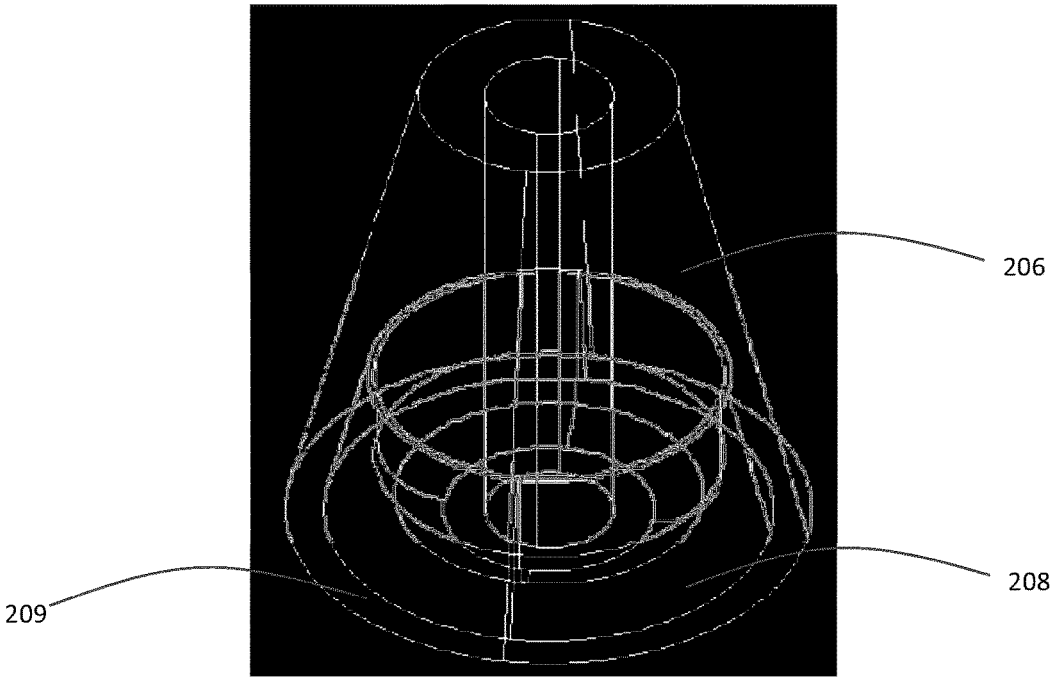
FIG. 4C shows an outline schematic of the topper according to the embodiment of the present invention shown in FIG. 4B.
Figure 4D:
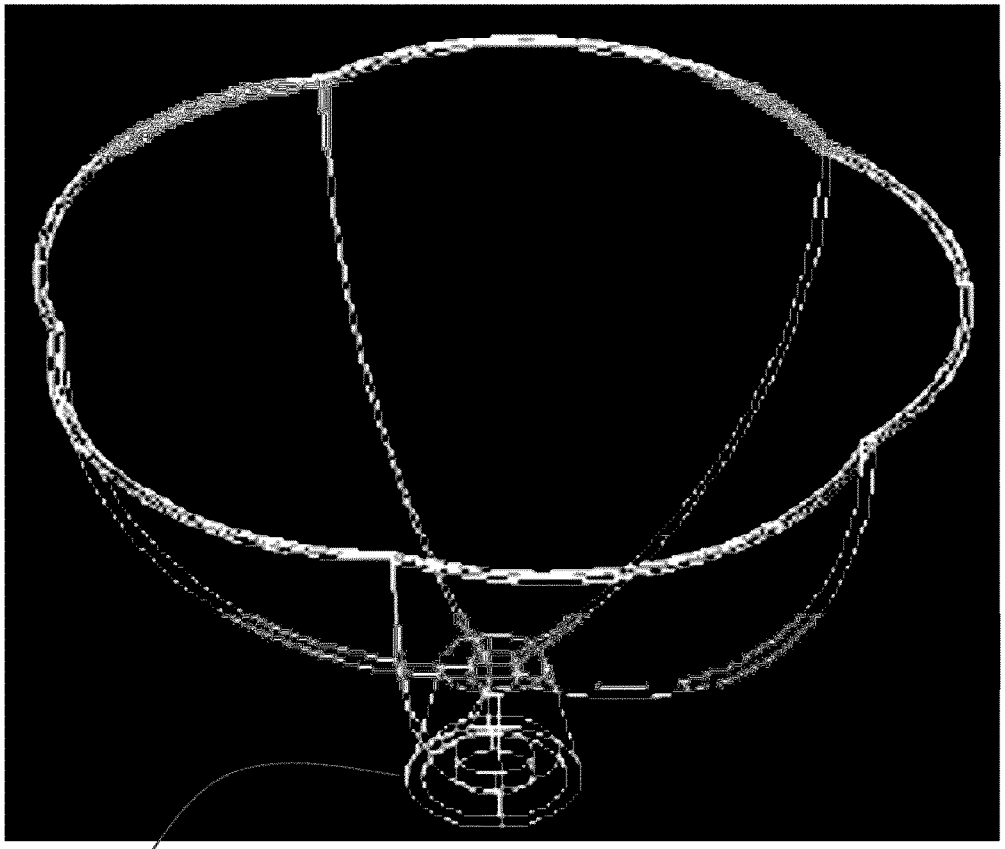
FIG. 4D shows a schematic of the topper according to an embodiment of the present invention where the topper is a dip-container.

FIG. 4C shows an outlined schematic of the topper 206 according to the embodiment of the present invention shown in FIG. 4B.

Figure 5:
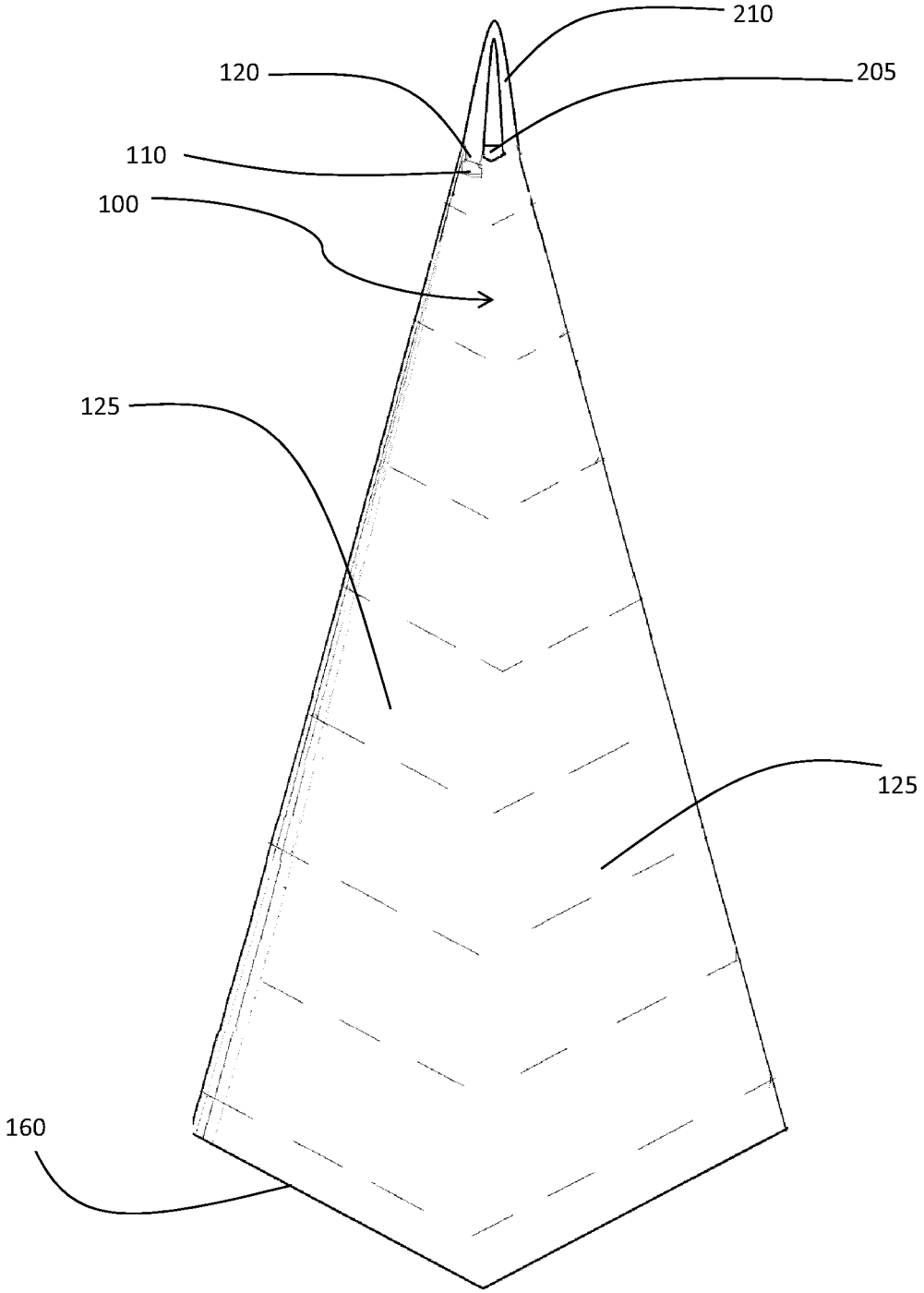
FIG. 5 shows a pyramid-shaped assembled base of the display stand according to another embodiment of the present invention.

FIG. 5 shows an assembled base sheet 100 with a handle 210 near the opening 205. In this embodiment of the present invention, the assembled base sheet 100 has three sheet surfaces 125 forming a pyramid shape. The bottom edge 160 forms a triangular base. The base sheet 100 may have scoring lines (not shown) to facilitate assembly. One end of the handle 210 may be continuous with the base sheet 100 with an insert 110 at an opposing end. Here, the insert 110 mates with a slit 120 in the base sheet 100 to form a handle 210.

Figure 6:
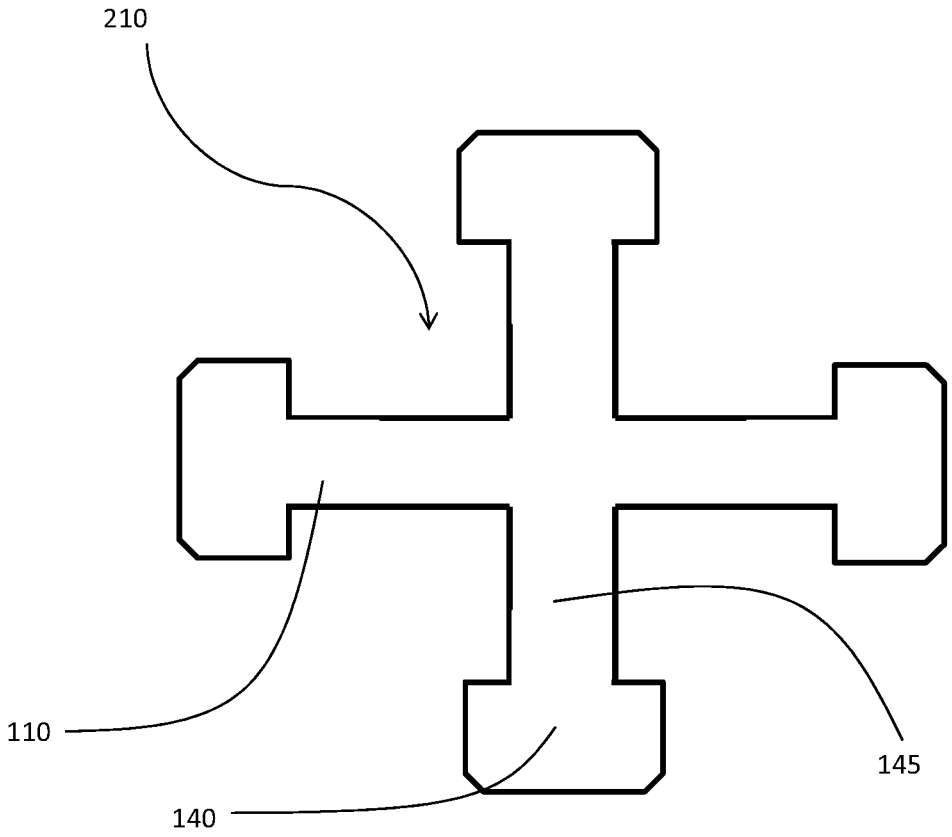
FIG. 6 shows a top handle of the display stand according to a further embodiment of the present invention.

FIG. 6 shows the handle 210 as a separate unit. The handle 210 may have one or more inserts 110 that mate with slits 120 on a sheet surface 125 (not clearly shown). In FIG. 6, the inserts 110 have a head 140 and a neck 145. Alternatively, the handle 210 may include slits that mate with a base sheet 100 including inserts 110 (not shown).

Figure 7A:
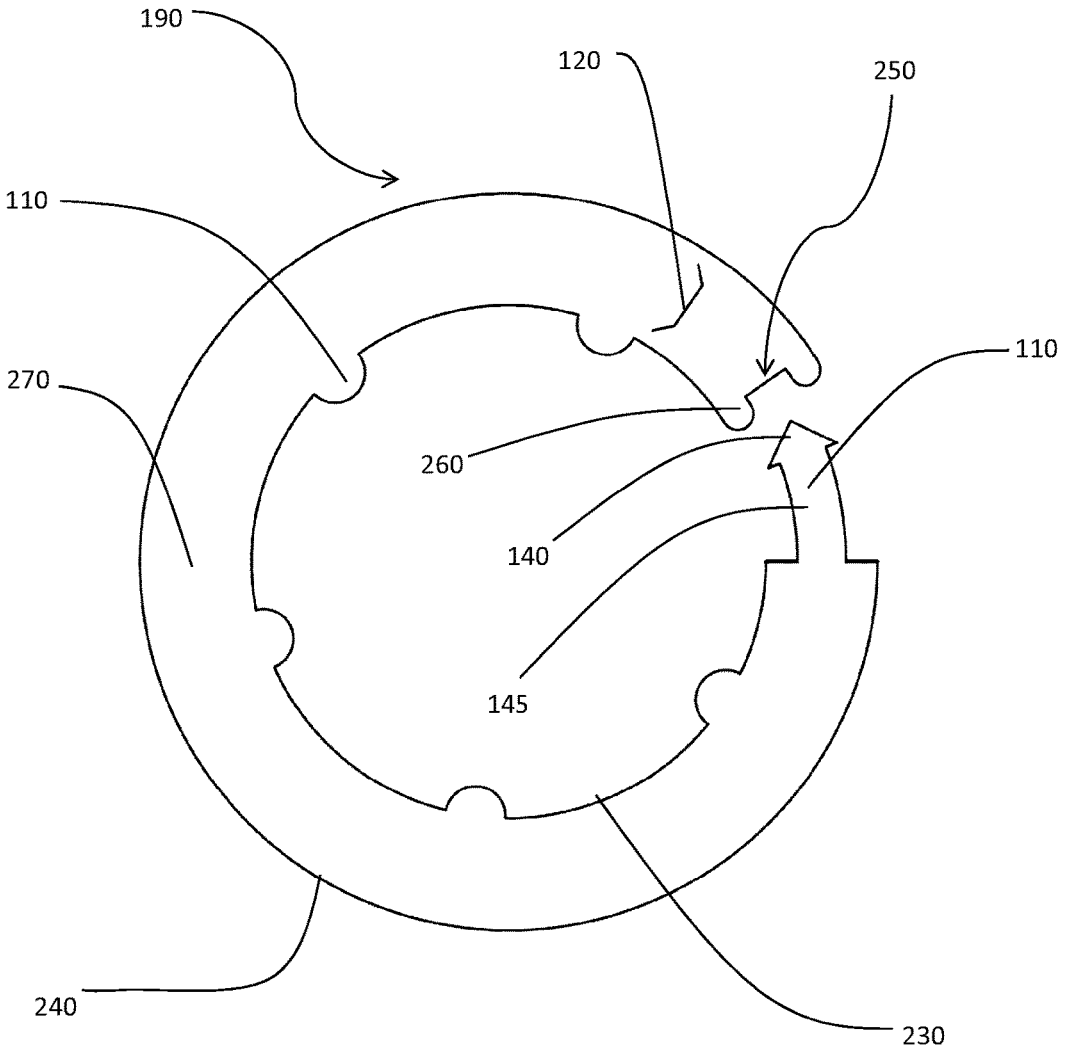
FIG. 7A shows a shelf sheet of the display stand according to another embodiment of the present invention.

FIG. 7A shows a shelf sheet 190 that includes inserts 110 along the inner edge 230 and a head 140 for mating with slits 120 on the base sheet 100. The outer edge 240 and the inner edge 230 of the shelf sheet 190 may be scalloped or uneven for decorative purposes. In FIG. 7A, the shelf sheet 190 has at least one insert 110 and at least one slit 120. In another embodiment of the present invention, the mating of the slit 120 with the insert 110 may have a secondary securing means 250. The secondary securing means 250 may include protrusions 260 that secure the neck 145 of the insert 110. The head 140 is inserted into the slit 120 and the neck 145 is secured by the protrusions 260 to form an assembled shelf sheet 190 (not shown).

In another embodiment of the present invention, multiple shelf sheets 190 may be mated together by the above mentioned connection means prior to assembly with the base sheet 100. The shelf sheet 190 has inserts 110. These inserts 110, which are along the inner edge 230, align and mate with slits 120 that run parallel to the bottom edge 160 of the base sheet 100.

Figure 7B:
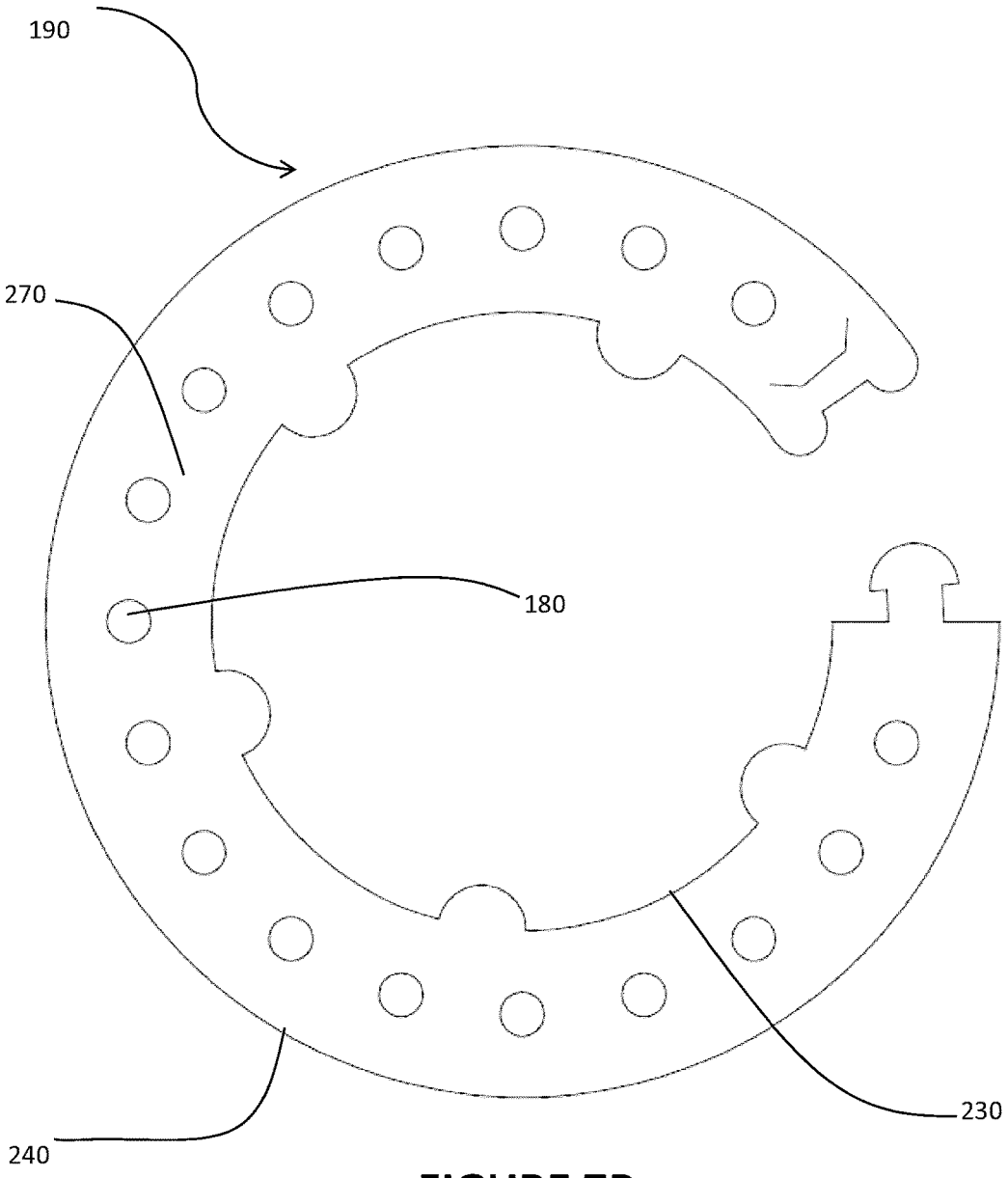
FIG. 7B shows a shelf sheet of the display stand according to a further embodiment of the present invention.

The shelf sheet 190 may also include at least one hole 180 in the shelf surface 270 as shown in FIG. 7B. The holes 180 allow for increased decorative versatility of the display stand 290. The holes 180 facilitate the display of items with pointed bottoms, including but not limited to cone-shaped items or items on a stick, such as lollipops, cake pops or stemmed flowers.

Figure 8:
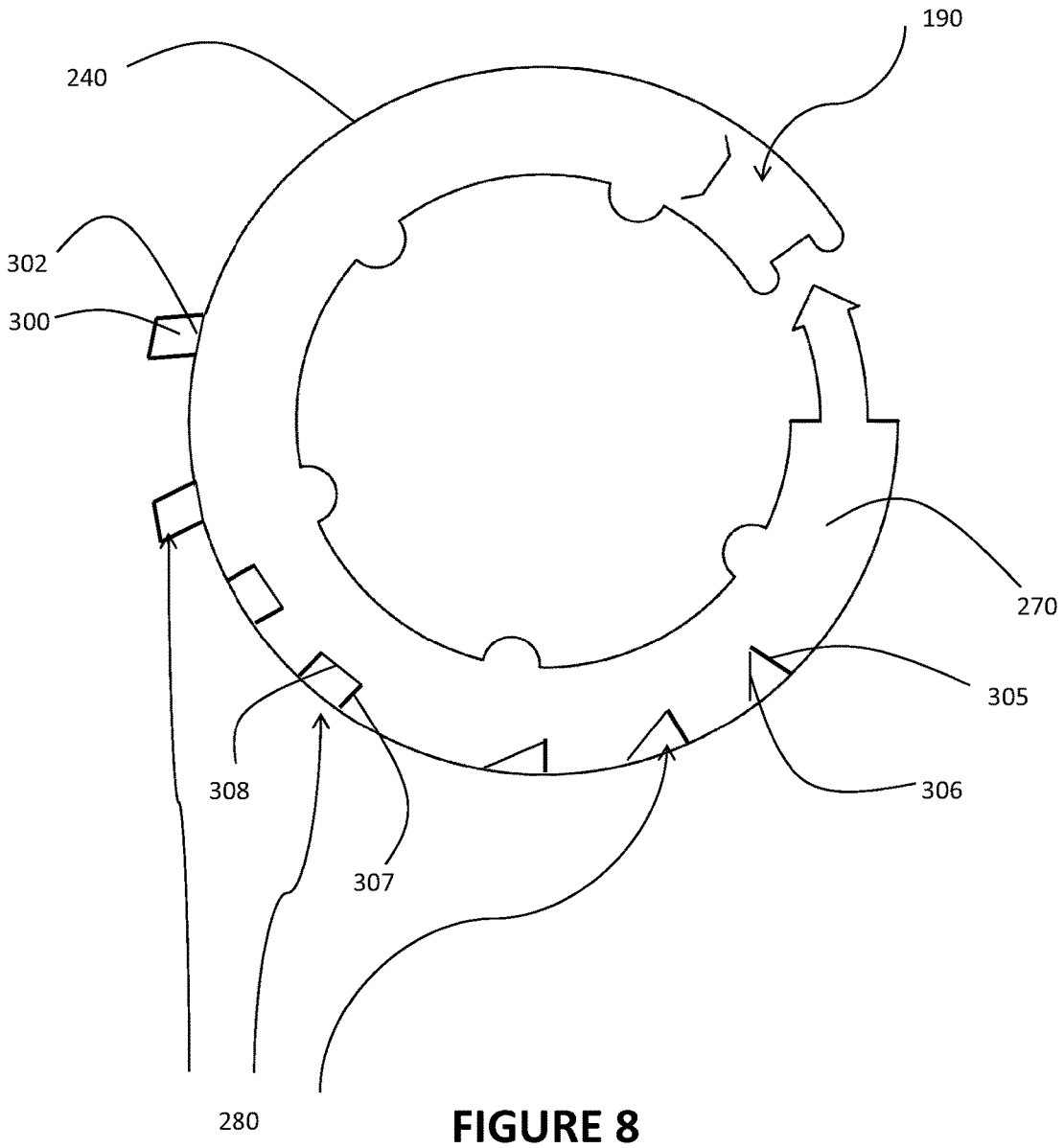
FIG. 8 shows a shelf sheet of the display stand according to a further embodiment of the present invention.

The shelf sheets 190 may have notches 280 along an outer edge 240 of the shelf surface 270 as shown in FIG. 8. These notches 280 may help to prevent the item on display from falling off the shelf sheets 190 in an assembled display stand 290 (shown in FIGS. 10-16). Such notches 280 may include, but are not limited to, protrusions 300 along the outer edge 240 that are folded upward along optional scoring lines 302; slits 305 folded upward at an angle with respect to the shelf surface 270 along optional scoring lines 306; or slits 307 folded upward along optional scoring lines 308 running parallel to the outer edge 240. The slits 305 and 307 may form any design, including but not limited to a straight or curved line, or an L-shape. The protrusions 300 may form any shape or design, including circular, rectangular, heart shaped, or irregularly shaped. A given shelf sheet 190 may include any combination of the described notches 280.

Figure 9:
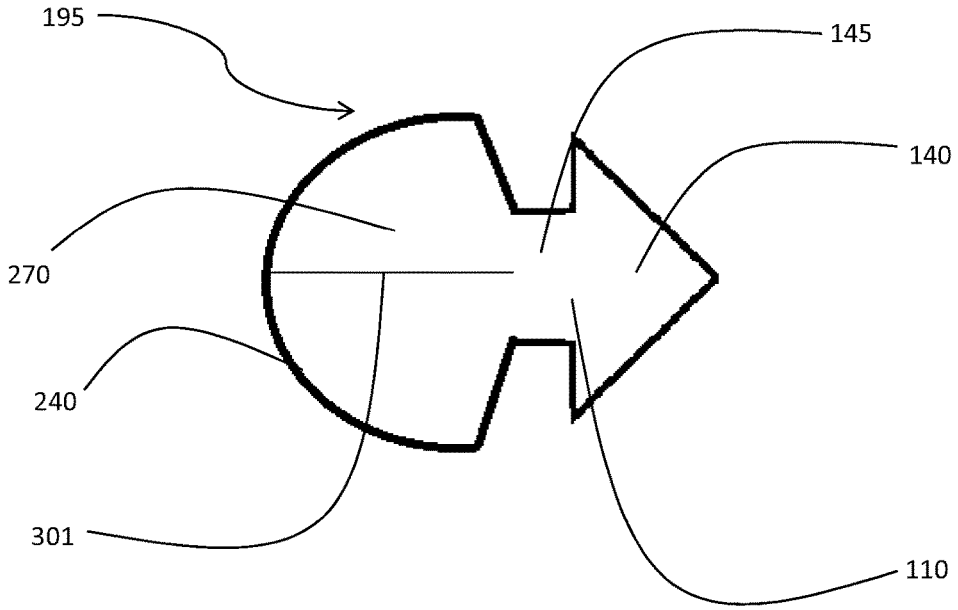
FIG. 9 shows a modified shelf sheet of the display stand with a singular insert according to a further embodiment of the present invention.

FIG. 9 shows an embodiment of a modified shelf sheet 195 with a singular insert 110 for mating with a slit 120 on the base sheet 100. In this embodiment, the modified shelf sheet 195 has an insert 110 with both a neck 145 and a head 140. The modified shelf sheet 195 may include more than one insert 110 and may also have a scoring line 301 to help shape the modified shelf sheet's 195 shelf surface 270. The modified shelf sheet is suited for one or a few objects to display.

Figure 10:
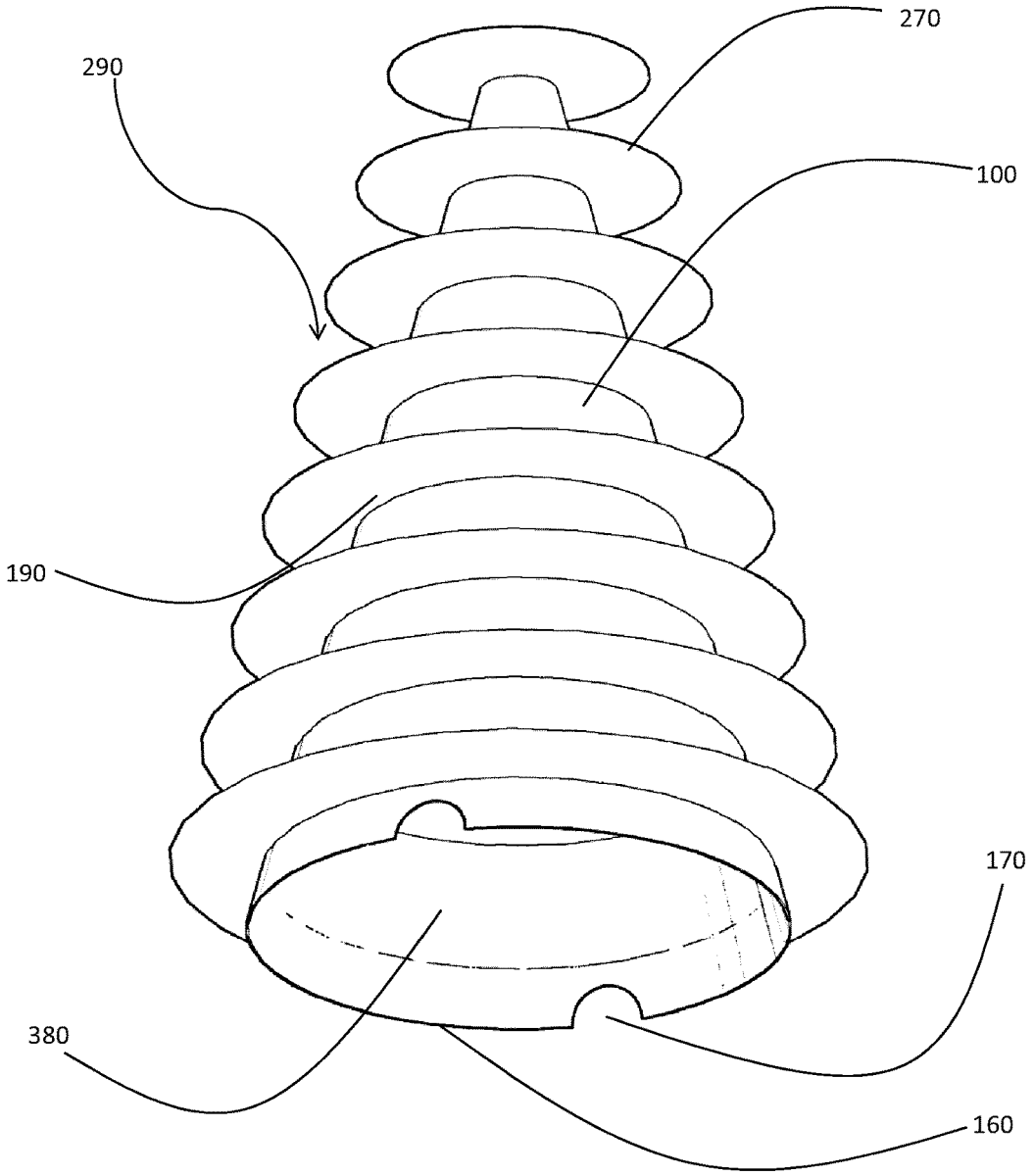
FIG. 10 shows a cone-shaped assembled display stand according to another embodiment of the present invention.

FIG. 10 shows one embodiment of an assembled display stand 290 including one assembled base sheet 100 and eight assembled shelf sheets 190. The base sheet 100 of the display stand 290 forms a hollow inner compartment 380. The shelf surfaces 270 of the shelf sheets 190 may be angled upwards to prevent items from falling and to provide further structural integrity. In this embodiment of the present invention, the bottom edge 160 of the base sheet 100 includes two indentations 170 for carrying an assembled and/or decorated display stand 290.

In another embodiment of the present invention, the bottom edge 160 and top edge 200 of the base sheet 100 may be scalloped or uneven for decorative purposes (not shown). Such scalloped or uneven bottom edges 160 may include indentations 170 for transporting an assembled and/or decorated display stand 290.

In a further embodiment of the present invention, the shelf surface 270 may be parallel to the surface on which the display stand 290 is placed. In a another embodiment of the present invention, the shelf surface 270 may be angled downwards, in which case display items may be skewered onto or adhered to the shelf sheets 190 (not shown). For example, a notch 280 may pierce or skewer a display item to hold it in place.

Figure 11:
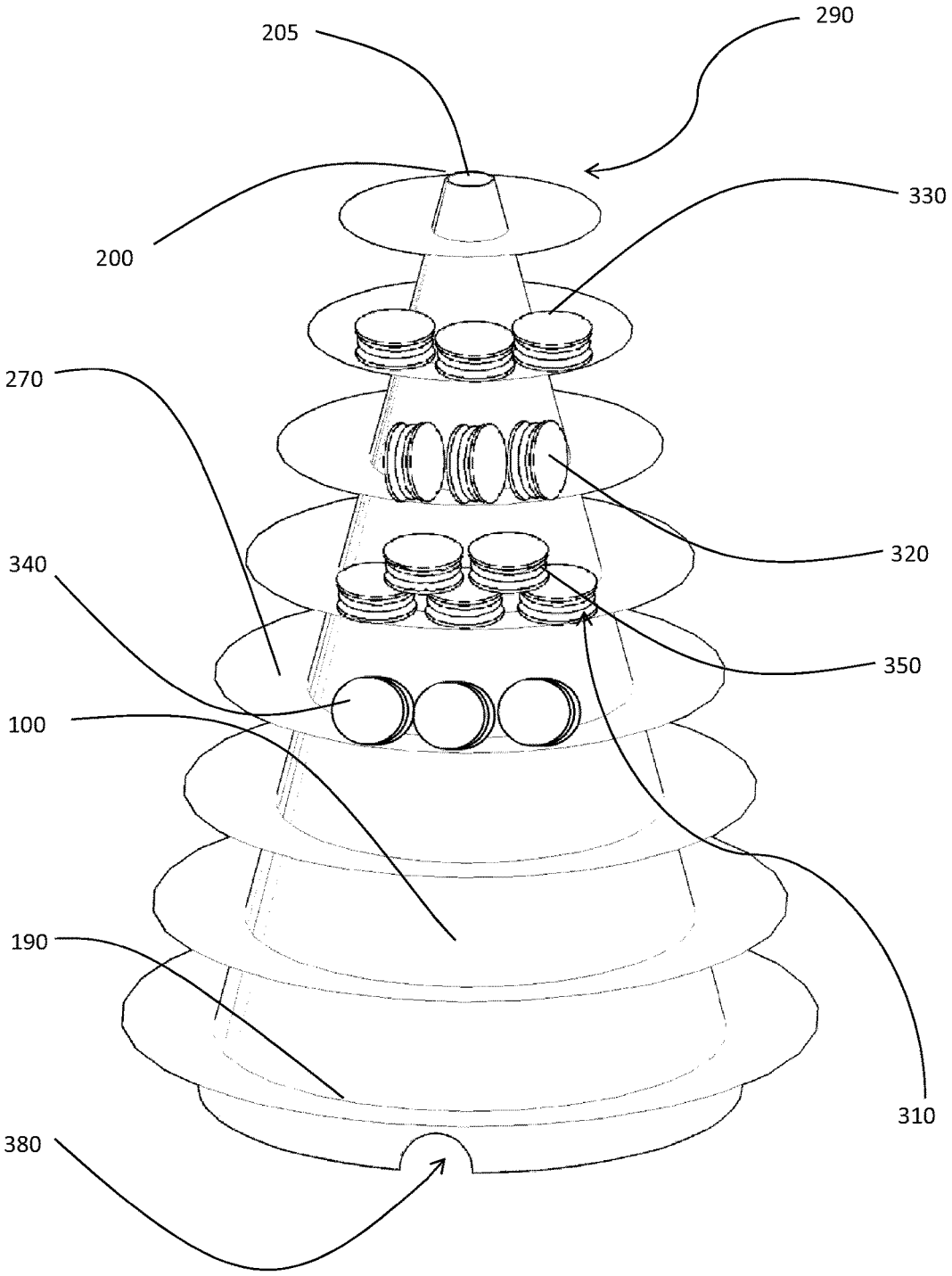
FIG. 11 shows a cone-shaped assembled display stand partly decorated with French macaron desserts according to a further embodiment of the present invention.

FIG. 11 shows an embodiment of the display stand 290 with eight assembled shelf sheets 190 mated with a conical assembled base sheet 100. In this embodiment, the shelf surfaces 270 of four of the shelf sheets 190 are partially decorated with French macarons 310.

These desserts may be displayed on the shelf surfaces 270 of the shelf sheets 190 vertically 320, horizontally 330 or outwardly facing 340. In this embodiment, the French macarons may also be stacked 350 when displayed horizontally 330.

Figure 12:
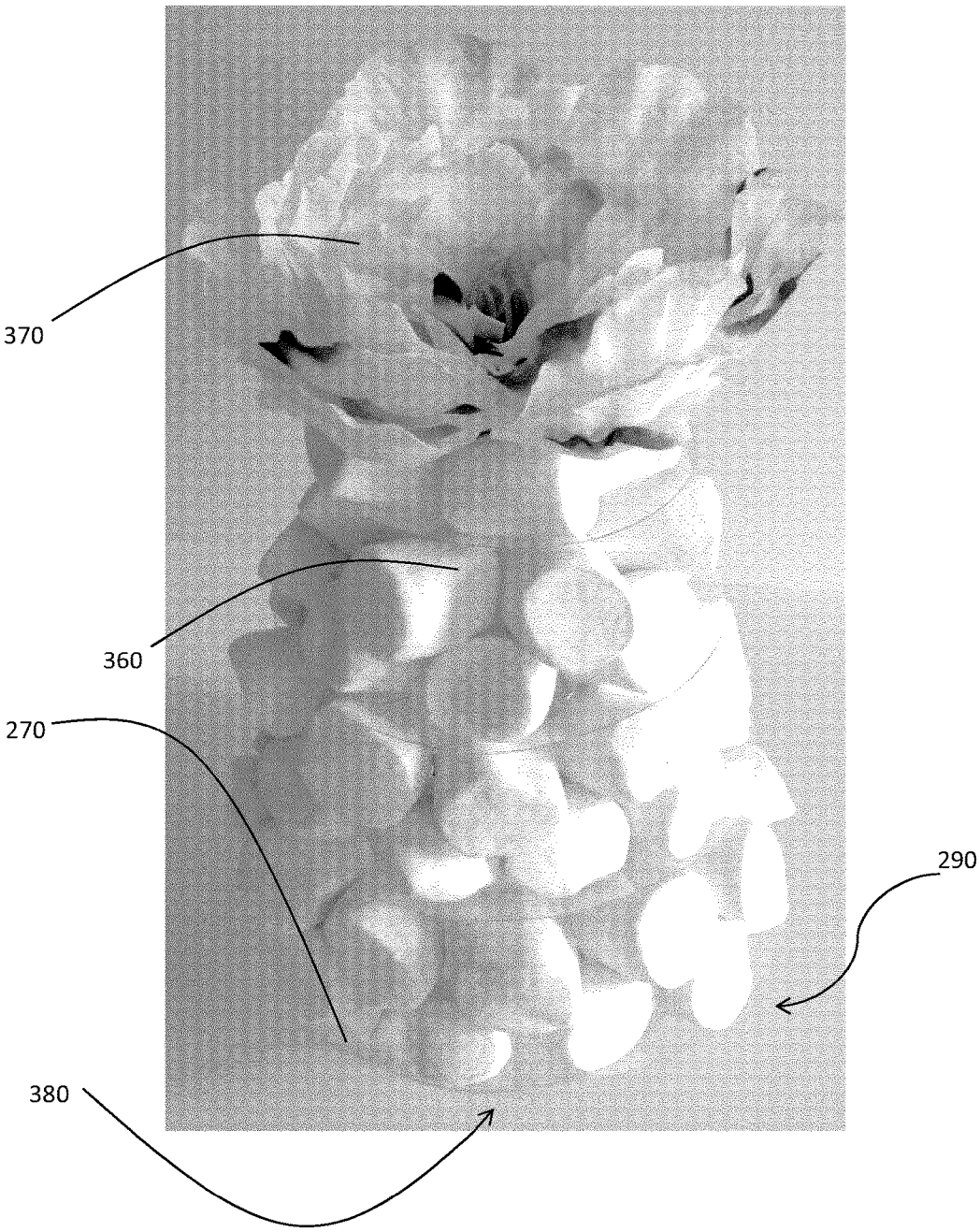
FIG. 12 shows a cone-shaped assembled display stand decorated with marshmallows and flowers according to another embodiment of the present invention.

FIG. 12 shows a display stand 290 decorated with marshmallows 360 and flowers 370. The opening 205 (not visible) leads to the hollow inner compartment 380 and may function as a vase for the flower 370. The opening 205 may also function as a vase for breadsticks or other items.

In another embodiment of the present invention, the conical variation of the display stand 290 may be decorated with French choux pastries and caramel to assemble the French decorative dessert, croquembouche (not shown).

Figure 13:
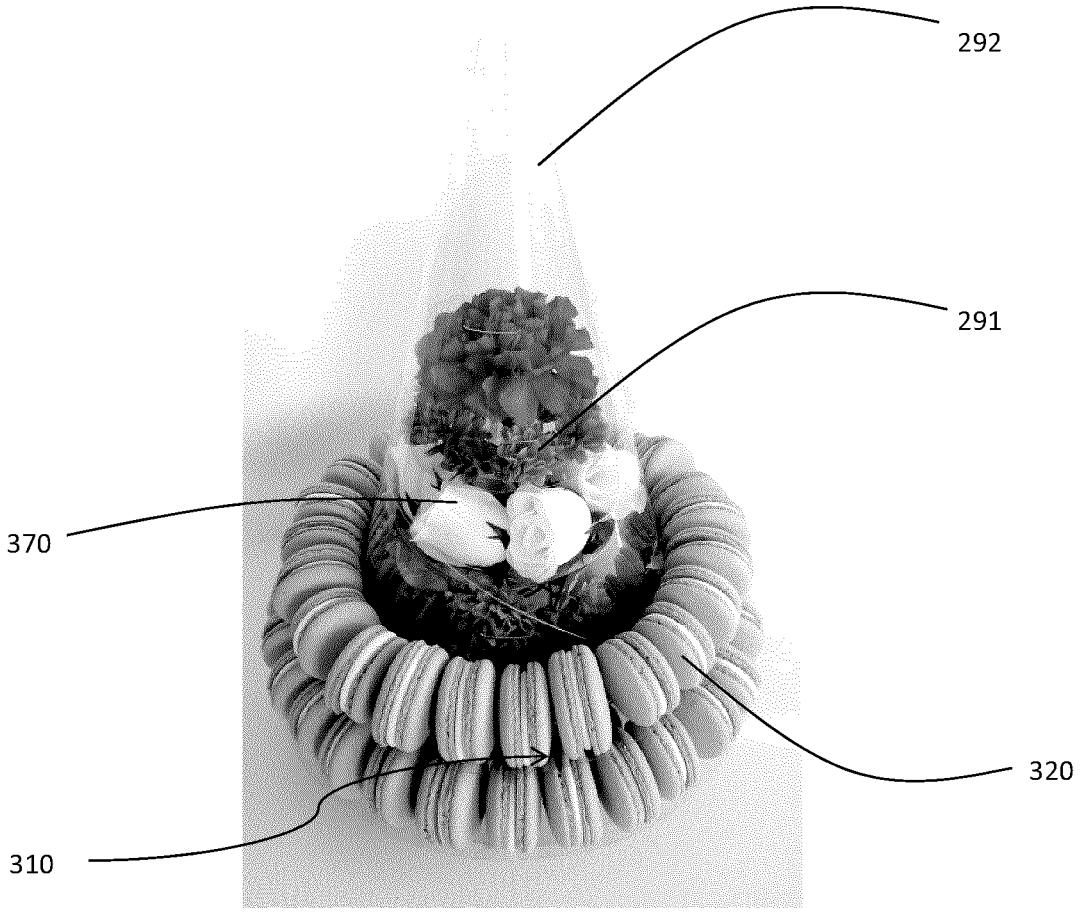
FIG. 13 shows a small assembled display stand decorated with flowers and nested within a large assembled display stand decorated with French macaron desserts according to a further embodiment of the present invention.

The present invention may be constructed in different sizes. In one embodiment of the present invention, smaller assembled and/or decorated display stands 291 can nest within larger assembled and/or decorated display stands 292. In FIG. 13, a small assembled display stand 291 decorated with flowers 370 is nested within a large assembled display stand 292 decorated with French macarons 310 placed vertically 320. Alternatively, if several display stands 290 were filled with desserts such as French macarons 310 and nested within one another, a large assembled display stand 292 where all the desserts have been removed could be lifted by a user, revealing a decorated small assembled display stand 291 underneath. This may provide convenience of time and space for many users.

This may also provide increased decorative variability.

In another embodiment of the present invention, the hollow inner compartment 380 of the display stand 290 may be used as a storage space.

Figure 14:
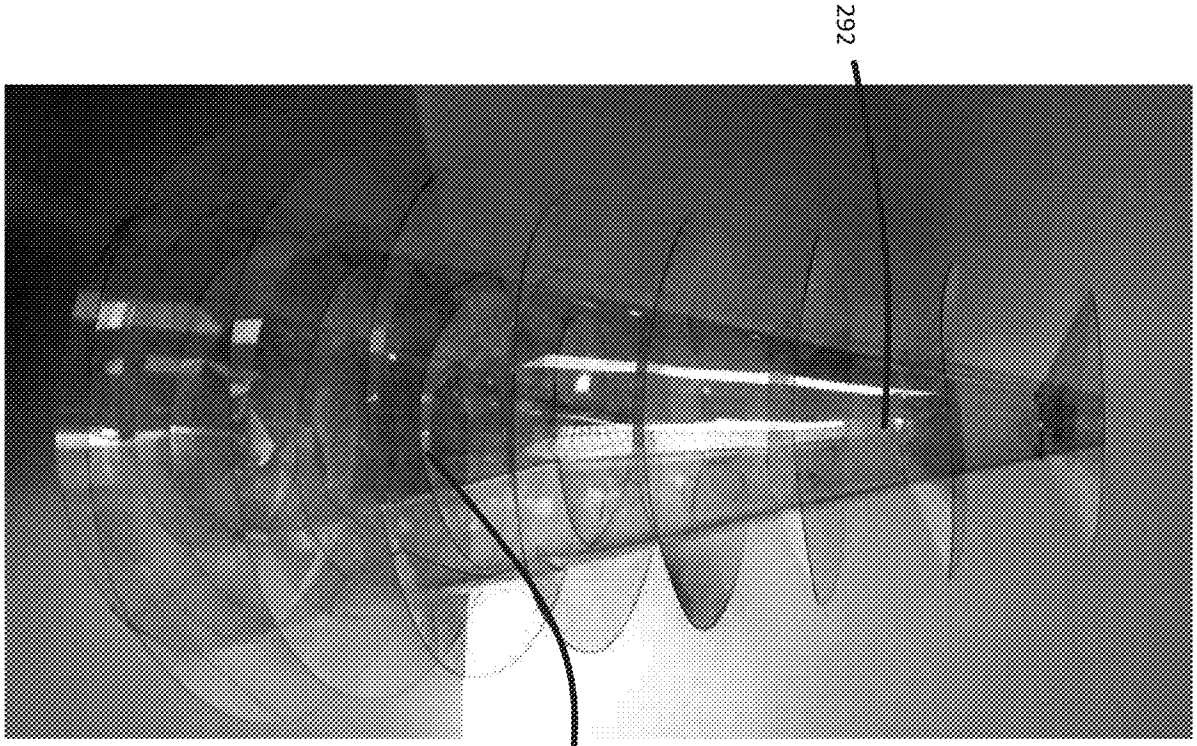
FIG. 14 shows a smaller assembled display stand nested within a larger assembled display stand.

FIG. 14 shows a small undecorated transparent display stand 291 nested within a large undecorated transparent display stand 292.

Figure 15:
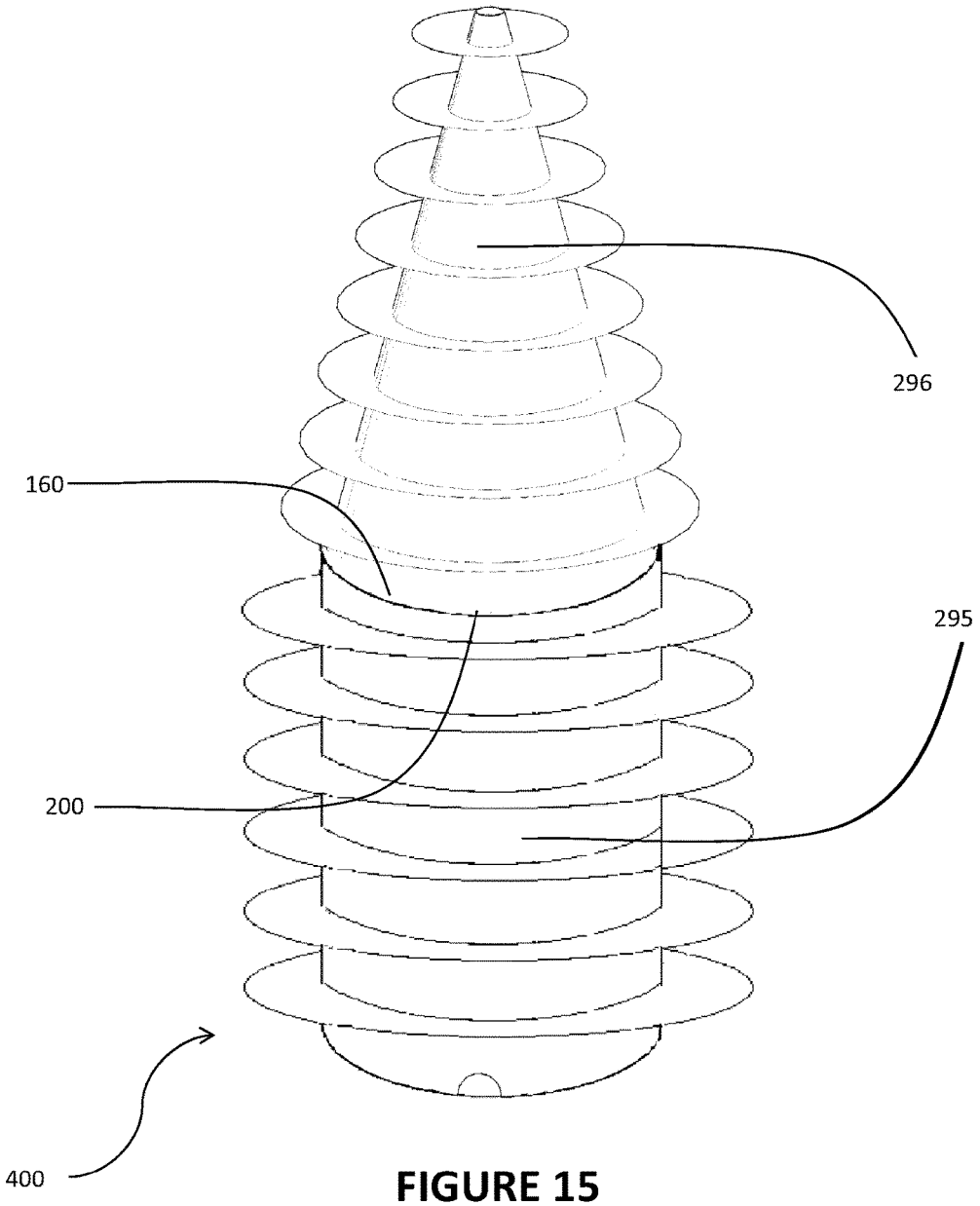
FIG. 15 shows two assembled display stands vertically connected to one another according to a further embodiment of the present invention.

In a further embodiment of the present invention, one or more display stands 290 may be connected to each other to create complex structures. FIG. 15 shows a display stand structure 400 including an assembled cylindrical display stand 295 vertically connected to an assembled conical display stand 296. In this embodiment of the present invention, the bottom edge 160 of the conical display stand 296 is connected to the top edge 200 of the cylindrical display stand 295. In an embodiment of the present invention, the connection means includes separate connecting units with inserts 110 that mate with slits 120 in the sheet surface 125 near the top edge 200 and bottom edge 160 of each display stand 290 (not shown). In another embodiment of the present invention, inserts 110 and/or slits 120 situated on the sheet surface 125 at the top edge 200 and/or bottom edge 160 of each base sheet 100 connect the display stands 290 together vertically.

Figure 16:
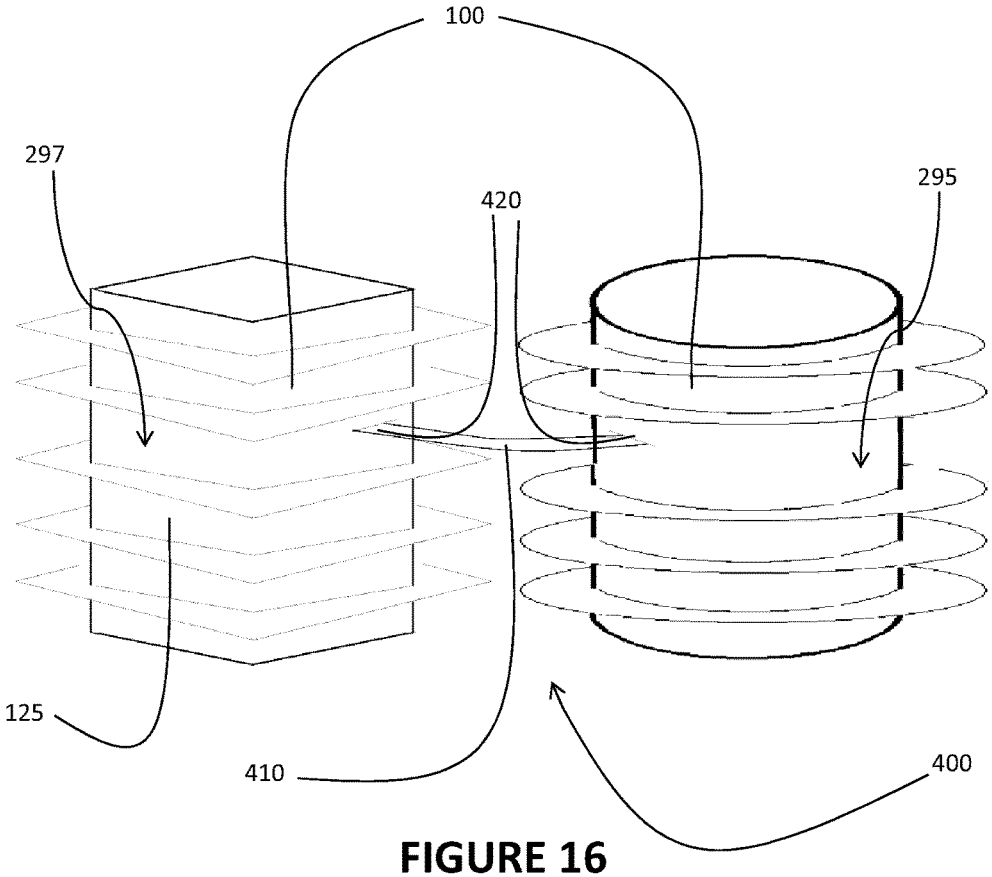
FIG. 16 shows two assembled display stands horizontally connected to one another by an interconnecting shelving unit according to a further embodiment of the present invention.

FIG. 16 shows another embodiment of the present invention wherein a rectangular display stand 297 is laterally connected by an interconnecting shelf sheet 410 to a cylindrical display stand 295. The rectangular display stand 297 has four sheet surfaces 125. The interconnecting shelf sheet 410 may include inserts 110 at opposing edges 420 for mating with slits 120 on the connected base sheets 100. Therefore, the present invention allows for a multitude of variations of complex and creative display stand structures 400.

Other embodiments of the present invention may include a base sheet 100 with one or more sheet surfaces 125. In another embodiment of the present invention, the base sheet 100 may form a pyramid shape with four or more sheet surfaces 125. In a further embodiment of the present invention, the base sheet 100 may form a cylinder or a dome with a single sheet surface 125. Unassembled base sheets 100 and shelf sheets 190 may include scoring lines 301 to define edges for folding to facilitate assembly of the display stand 290.

Figure 17:
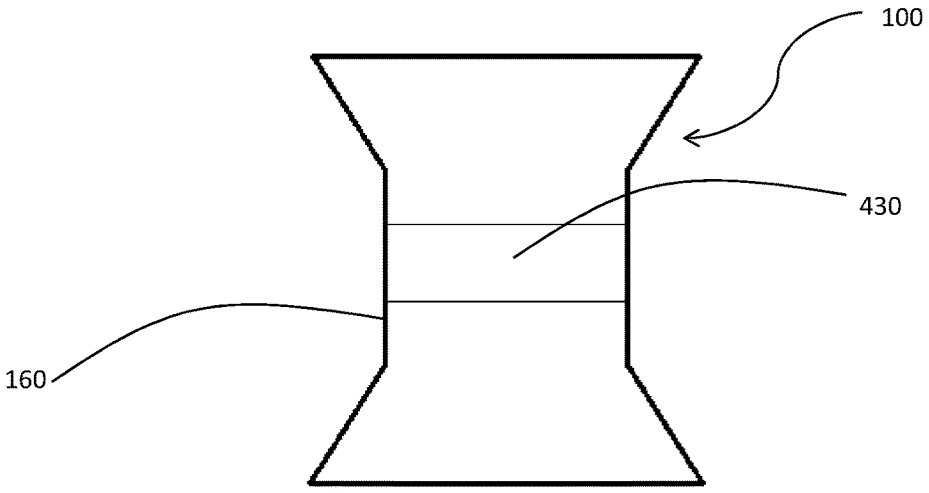
FIG. 17 shows a bottom view of a bridging unit according to another embodiment of the present invention.

FIG. 17 shows a bottom view of a base sheet 100 (not visible) wherein the bottom edge 160 forms an irregular shape. A bridging unit 430 is included to help maintain the irregular shape of the assembled base sheet 100. The bridging unit 430 may connect with at least two regions of the bottom edge 160 of the base sheet 100 to help provide structural integrity to the display stand 290. The bridging unit 430 may be connected to the base sheet 100 by way of a connection means such as inserts 110 and slits 120 as described above (not shown). In another embodiment of the present invention, the bridging unit 430 may be continuous with the base sheet 100 material and mated with another region of sheet surface 125 near the bottom edge 160 of the base sheet 100 by a connection means such as inserts 110 and slits 120.

In one embodiment of the present invention, the assembled display stand 290 may be adorned from within, in the hollow inner compartment 380, and/or decorated around the sheet surfaces 125, opening 205, or shelf surfaces 270. The present invention may be utilised as a display for a variety of objects, such as desserts or flowers. In another embodiment of the present invention, the display stand 290 itself may serve as a decoration by its design and ornamentation.

The display stand 290 may be constructed of any flexible material, including but not limited to plastic, PVC, acetate, paper products such as cardboard, acrylic and flexible metals such as metal foil or aluminum alloys. For food-related embodiments of the display stand, the material should be food-safe. The material used for the present invention may be disposable, recyclable and/or re-usable.

Furthermore, the material of the display stand may be opaque, translucent, transparent, patterned, colored, or include any design. Embodiments of the present invention may utilize several of the afore-mentioned materials in combination. For example, a display stand 290 with a plastic base sheet 100 may mate with metal and/or acrylic shelf sheets 190. Alternatively, a display stand 290 with a metal base sheet 100 may mate with paper and/or PVC shelf sheets 190. The choice of material is optimally inexpensive, sturdy and lightweight.

Figure 18:
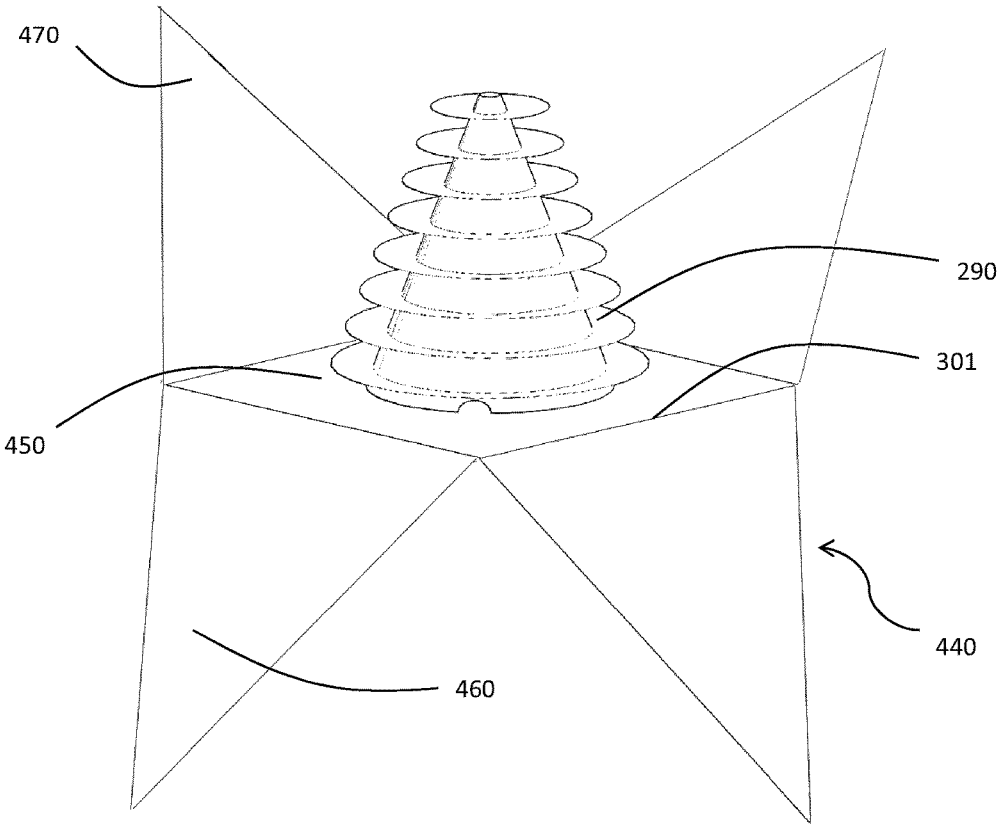
FIG. 18 shows a display stand with an unassembled display box according to another embodiment of the present invention.

Another embodiment of the present invention may include a protective and/or decorative display box 440 (shown in FIG. 18). The display box 440 may be used for transportation, gift or resale purposes of the display stand 290.

FIG. 18 shows one embodiment of the display box 440. In this embodiment, the unassembled display box 440 folds and unfolds around an assembled display stand 290 along scoring lines 301. In this embodiment, the display stand 290 may be placed in a central area 450 of the display box 440. The display box walls 460 fold up to join at the display box 440 wall tops 470 by a connection means (not shown). The connection means may include an adhesive, a rope or ties, inserts 110 and slits 120 as described above, or other connection means. In another embodiment of the present invention, the walls 460 of the display box 440 may include inserts 110 and/or slits 120 that may mate with an adjacent display box wall 460. The display box 440 may form the same or a different shape as the housed display stand 290.

Figure 19A:
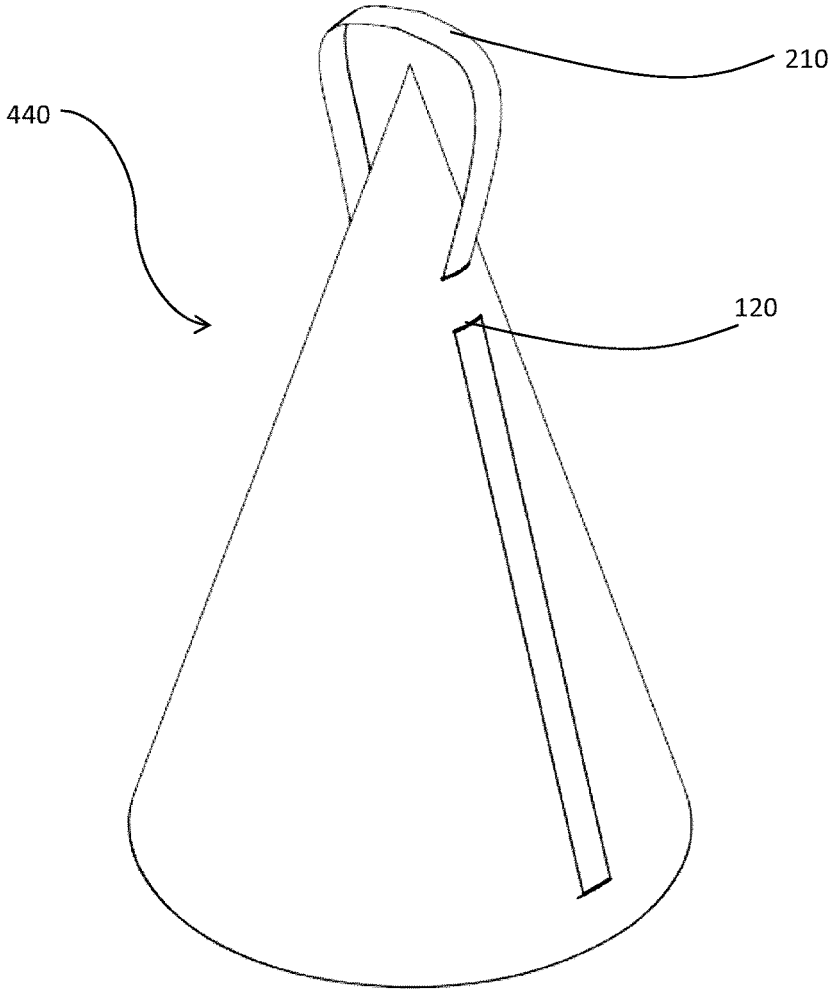
FIG. 19A shows a conical display box according to a further embodiment of the present invention.

FIG. 19A shows another embodiment of the display box 440 where the display box 440 has a conical shape. In this embodiment, the display box 440 is constructed and arranged with connection means. The connection means may include inserts 110 and slits 120 similar to those utilized in FIG. 1. In another embodiment of the present invention, the display stand 440 may include a central portion 450 as a separate unit, connected to the display box by a connection means (not shown).

The handle 210 may be contemplated by the skilled artisan as being continuous with the material of the display box 440 or may be connected to the display box 440 by a connection means, such as inserts 110 and slits 120 in the surface of the display box 440.

Figure 19B:
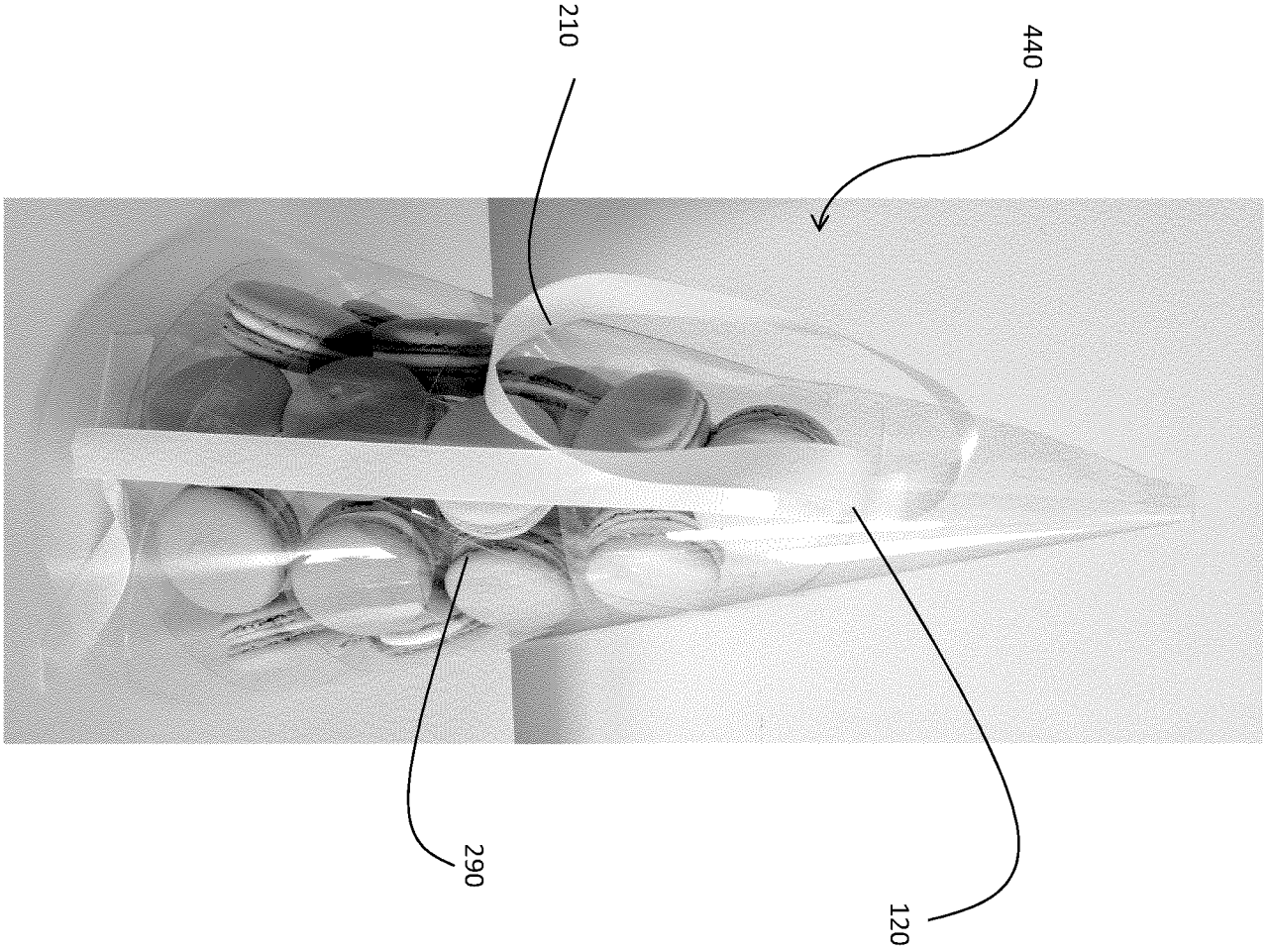
FIG. 19B shows a display stand with a conical display box according to another embodiment of the present invention.

FIG. 19B shows another embodiment of the present invention including a transparent conical display box 440. Here, the handle 210 is a separate unit that mates with slits 120 along the display box 440 walls. In this embodiment, the handle 210 is constructed of a fabric material. As may be readily contemplated by a skilled artisan, the material of the handle 210 may include any material that can bear the weight of an assembled and/or decorated display stand 290. The material of the handle may also be made of any material of which the display stand 290 or display box 440 are constructed from. The handle 210 may also bridge across the bottom of the display box 440 to provide support for lifting the display stand 290 (not clearly shown). The bridging across the bottom of the display box 440 may be contemplated as mating one end of the handle 210 to another end of the same handle 210, or by mating at least one end of the handle 210 to the display box 440. As an example, the handle 210 may be connected to itself or to the display box 440 by way of a connection means as described above, or by means of a knot.

In another embodiment of the present invention, the display box 440 walls 460 may include inserts 110 that mate with slits 120 in a handle 210 (not shown).

In another embodiment of the present invention, the display stand 290 may be placed in a pre-assembled display box 440 (not shown). In a further embodiment of the present invention, the display box 440 and display stand 290 may include connection means to secure the display stand 290 to the display box 440 such as inserts 110 or slits 120 (not shown).

The display box 440 may be constructed of any material, including but not limited to plastic, PVC, acetate, paper products such as cardboard, acrylic and metals such as aluminum alloys. The material used for the display box 440 may be disposable, recyclable and/or re-usable. The display box 440 may be constructed of the same materials as the display stand 290 it is meant to house, or may be constructed of other materials. Furthermore, the material of the display box 440 may be opaque, translucent, transparent, patterned, colored, or include any design.

Figure 20:
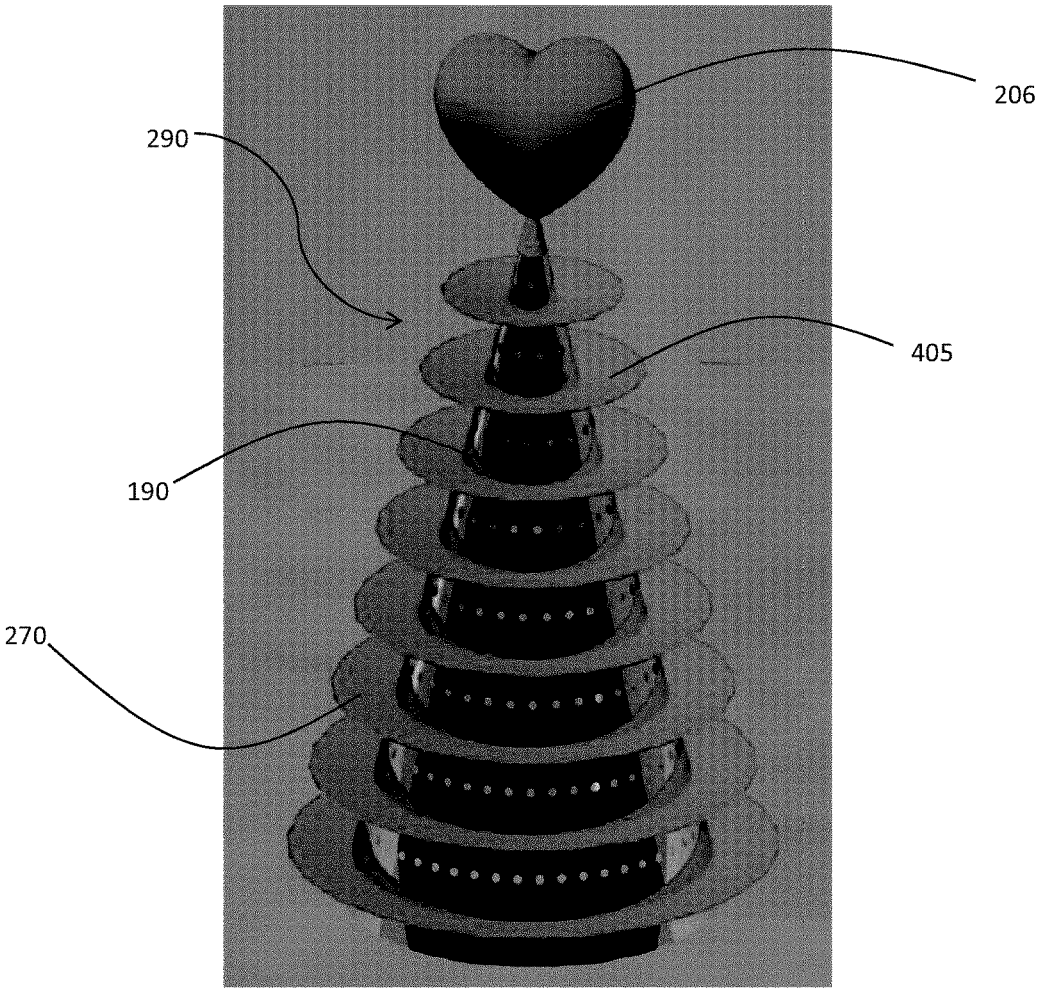
FIG. 20 shows a display stand with a heart-shaped balloon topper and shelf liners according to another embodiment of the present invention.

FIG. 20 shows a cone-shaped display stand 296 with a topper 206. The topper 206 in this embodiment is a heart-shaped balloon. In this embodiment of the present invention, at least one shelf sheet liner 405 is placed on the shelf sheet 190 for added versatility of the design. The shelf sheet liner 405 may cover at least a portion of the shelf surface 270 of the shelf sheet 190. The shelf sheet liner 405 may be decorative including any pattern or design, and/or may serve other useful purposes. For example, a shelf sheet liner may be constructed of an absorbent material to absorb any excess grease or liquid from an item on display. In another embodiment, the shelf sheet liner may be constructed of an adhesive material to help maintain the positioning of the item on display.

Figure 21:
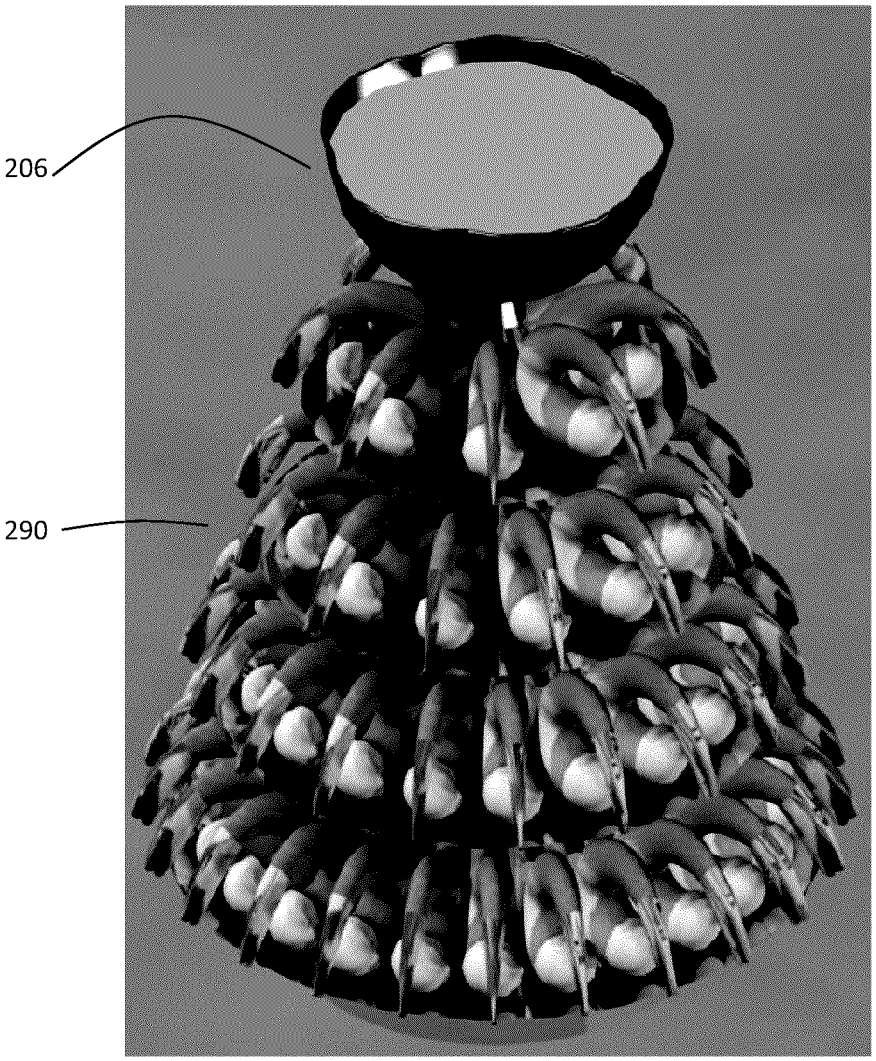
FIG. 21 shows a display stand decorated with shrimp and with a dip-container topper according to a further embodiment of the present invention.
Figure 22:
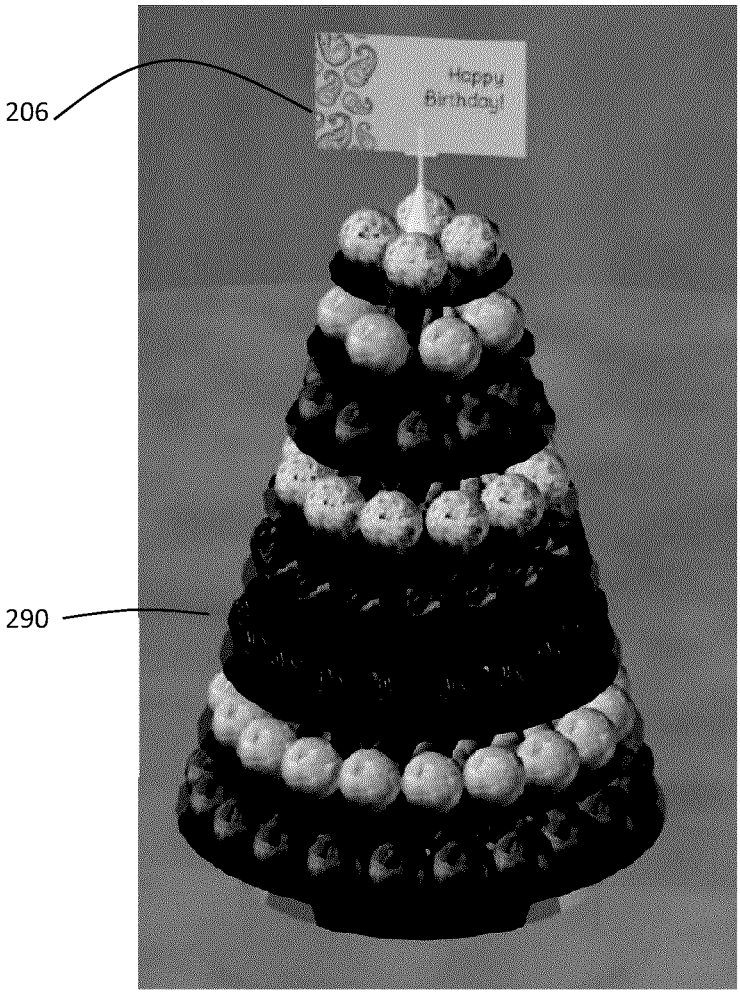
FIG. 22 shows a display stand with a card-holder topper and decorated with round items according to another embodiment of the present invention.

For illustrative purposes, FIG. 21 shows another embodiment of the display stand 290 decorated with shrimp and with a dip-container topper 206. FIG. 22 shows another embodiment of the display stand with a card-holder topper 206 and decorated with round items.

A person understanding this invention may now conceive of alternative structures and embodiments or variations of the above all of which are intended to fall within the scope of the invention as defined in the claims that follow.

What is claimed is:

1. A display stand comprising:

at least one base sheet, which when assembled forms a base unit, the at least one base sheet being planar and having an outward facing surface, an inward facing surface, and a bottom edge; and at least one shelf sheet having a shelf surface, the at least one shelf sheet being for attachment to the base unit, wherein the base unit is assembled by operatively attaching a first section of the at least one base sheet to a second section of the at least one base sheet by way of a first connection means;

the at least one base sheet comprises at least one adjustment line for adjusting the size of the base unit;

the at least one shelf sheet is attached to the base unit by way of at least one second connection means; and when the at least one shelf sheet is attached to the base unit, the at least one shelf sheet forms a contiguous planar surface around the outward facing surface of the at least one base sheet.

2. The display stand as in claim 1, wherein the first connection means is an opening and an insert, the insert being for insertion into the opening.

3. The display stand as in claim 1, wherein at least one of the first connection means and the second connection means comprises adhesive tape.

4. The display stand as in claim 1, wherein the at least one base sheet further comprises a transportation means for carrying the display stand.

5. The display stand as in claim 4, wherein the transportation means is at least one indentation along the bottom edge of the at least one base sheet.

6. The display stand as in claim 4, wherein the transportation means is a top handle.

7. The display stand as in claim 1, further comprising a topper for operatively attaching to the display stand, the topper being at least one of: a candle holder, a card holder, a clip, a dip-container, and a decorative sign denoting at least one of a phrase, an image, and a design.

8. The display stand as in claim 1, wherein the at least one base sheet comprises at least one hole for attaching a display item to the display stand.

9. The display stand as in claim 1, wherein the base unit forms a conical shape.

10. The display stand as in claim 1, further comprising a bridging unit for maintaining a shape of the base unit.

11. The display stand as in claim 1, wherein at least one of the first connection means and the second connection means comprises a secondary securing means.

12. The display stand as in claim 1, wherein the at least one shelf sheet comprises at least one notch along an outer edge for holding a display item on the display stand when the at least one shelf sheet is attached to the base unit.

13. The display stand as in claim 1, wherein a first display stand is nestable within a second display stand.

14. The display stand as in claim 1, wherein a third connection means operatively attaches a first display stand to a second display stand.

15. The display stand as in claim 1, wherein the display stand is constructed of a material selected from at least one of: plastic, PVC, acetate, paper products, cardboard, acrylic, flexible metals, metal foil, and aluminum alloys.

16. The display stand as in claim 15, wherein the material is at least one of: food-safe, disposable, recyclable, reusable, opaque, translucent, transparent, patterned, and colored.

17. The display stand as in claim 1, further comprising at least one shelf liner covering at least a portion of the shelf surface.

18. The display stand as in claim 1, further comprising a display box that is operatively attached to the display stand.

19. The display stand as in claim 18, further comprising a fourth connection means for operatively attaching the display box to the display stand.

20. A kit for assembly into a display stand, the kit comprising:

at least one base sheet being planar and having an outward facing surface, an inward facing surface, and a bottom edge; and at least one shelf sheet, the at least one shelf sheet having a shelf surface, an inner edge, and an outer edge, wherein the at least one base sheet is for assembling into the display stand by operatively attaching a first section of the at least one base sheet to a second section of the at least one base sheet by way of a first connection means;

the at least one base sheet comprises at least one adjustment line for adjusting the size of the display stand;

the at least one shelf sheet is attached to the display stand by way of a second connection means; and when the at least one shelf sheet is attached to the display stand, the at least one shelf sheet forms a contiguous planar surface around the outward facing surface of the at least one base sheet.

* * * * *